US008564633B2

(12) United States Patent
Matsushima et al.

(10) Patent No.: US 8,564,633 B2
(45) Date of Patent: Oct. 22, 2013

(54) THERMAL PRINTER

(75) Inventors: Gen Matsushima, Kiyose (JP); Yasuyuki Mori, Higashikurume (JP); Katsutoshi Mukaijima, Higashikurume (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 184 days.

(21) Appl. No.: 13/023,764

(22) Filed: Feb. 9, 2011

(65) Prior Publication Data

US 2011/0193927 A1 Aug. 11, 2011

(30) Foreign Application Priority Data

Feb. 10, 2010 (JP) ..... 2010-027830

(51) Int. Cl.
*B41J 2/335* (2006.01)

(52) U.S. Cl.
USPC ..... 347/197

(58) Field of Classification Search
USPC ..... 347/215, 217, 219, 222, 177, 197, 198, 347/218
See application file for complete search history.

(56) References Cited

U.S. PATENT DOCUMENTS 8,068,127 B2 * 11/2011 Ochiai et al. ..... 347/219

FOREIGN PATENT DOCUMENTS

JP 2000-52613 2/2000

* cited by examiner

*Primary Examiner* — Kristal Feggins
(74) *Attorney, Agent, or Firm* — Wenderoth, Lind & Ponack, L.L.P.

(57) ABSTRACT

A thermal printer includes a thermal printhead, a head cover configured to partially cover the thermal printhead, a paper container configured to house a paper, and a damper disposed on a paper feeding path between the thermal printhead and the paper container and configured to press the paper fed on the paper feeding path. The damper is combined with the head cover.

7 Claims, 23 Drawing Sheets

17
17c(17b,17d)
44
40
19b
(19a,19c,19d)
45
61
60
62
17c
19b
SECT.B-B

VIEW.D

VIEW.E

VIEW.D

VIEW.E

DETAIL.G

THERMAL PRINTER

CROSS REFERENCE TO RELATED APPLICATIONS

The present application is based on and claims priority from Japanese Application Number 2010-27830, filed on Feb. 10, 2010, the disclosure of which is hereby incorporated by reference herein in its entirety.

BACKGROUND OF THE INVENTION

1. Field of the Invention

The present invention relates to a thermal printer, more particularly, to an improvement of a damper to apply a tension to a paper (thermal paper) sent to a thermal printhead.

2. Description of the Related Art

In a thermal printer, a paper (thermal paper) contained in a paper container is fed to a position of a thermal printhead and then a thermal printing is performed by the thermal printhead. When printing is performed, the paper is required to be appropriately stretched by applying an appropriate tension to the paper.

Therefore, the damper is provided on a paper feeding path between the paper container and the thermal printhead and the damper is pressed on a surface of the paper fed to the thermal printhead to apply an appropriate tension to the paper.

In a technology disclosed in Japanese Patent Application Publication No. 2000-052613, a main body is provided with a platen roller and the paper container and a cover element capable of being opened and closed relative to the main body is provided with the thermal printhead and the damper. When the cover element is closed, the damper is pressed on the paper disposed on the path from the paper container to the thermal printhead and the platen roller. Since the damper is separately disposed on the cover element, the damper is positioned separately from the paper container and the thermal printhead, and thereby, it is required to ensure a certain interval between the paper container and the thermal printhead.

Thus, it is not possible to reduce an entire length of the thermal printer in a front-back direction (paper feeding direction) where the paper container and the thermal printhead are arranged, so that it is difficult to achieve the small size apparatus.

SUMMARY OF THE INVENTION

An object of the present invention is to provide a thermal printer with a reduced entire size, especially a reduced length in a front-back direction.

To achieve the above object, a thermal printer according to an embodiment of the present invention, includes a thermal printhead, a head cover configured to partially cover the thermal printhead, a paper container configured to house a paper, and a damper disposed on a paper feeding path between the thermal printhead and the paper container and configured to be pressed on the paper fed on the paper feeding path. The damper is combined with the head cover.

BRIEF DESCRIPTION OF THE DRAWINGS

Features, embodiments, and advantages of the present invention will become apparent from the following detailed description with reference to the accompanying drawings:

FIG. 6A is a perspective view thereof, FIG. 6B is a side view thereof with a spring extended, seen from the arrow A in FIG. 6A, and FIG. 6C is a side view thereof with the spring contracted, seen from the arrow A;

FIG. 9A shows the same corresponding to FIG. 5A, FIG. 9B shows the same without any vertical inclination seen from the arrow C in FIG. 9A, and FIGS. 9C, 9D show the same with a vertical inclination at either side in a width direction seen from the arrow C;

DETAILED DESCRIPTION OF THE PREFERRED EMBODIMENTS

Figure 1:
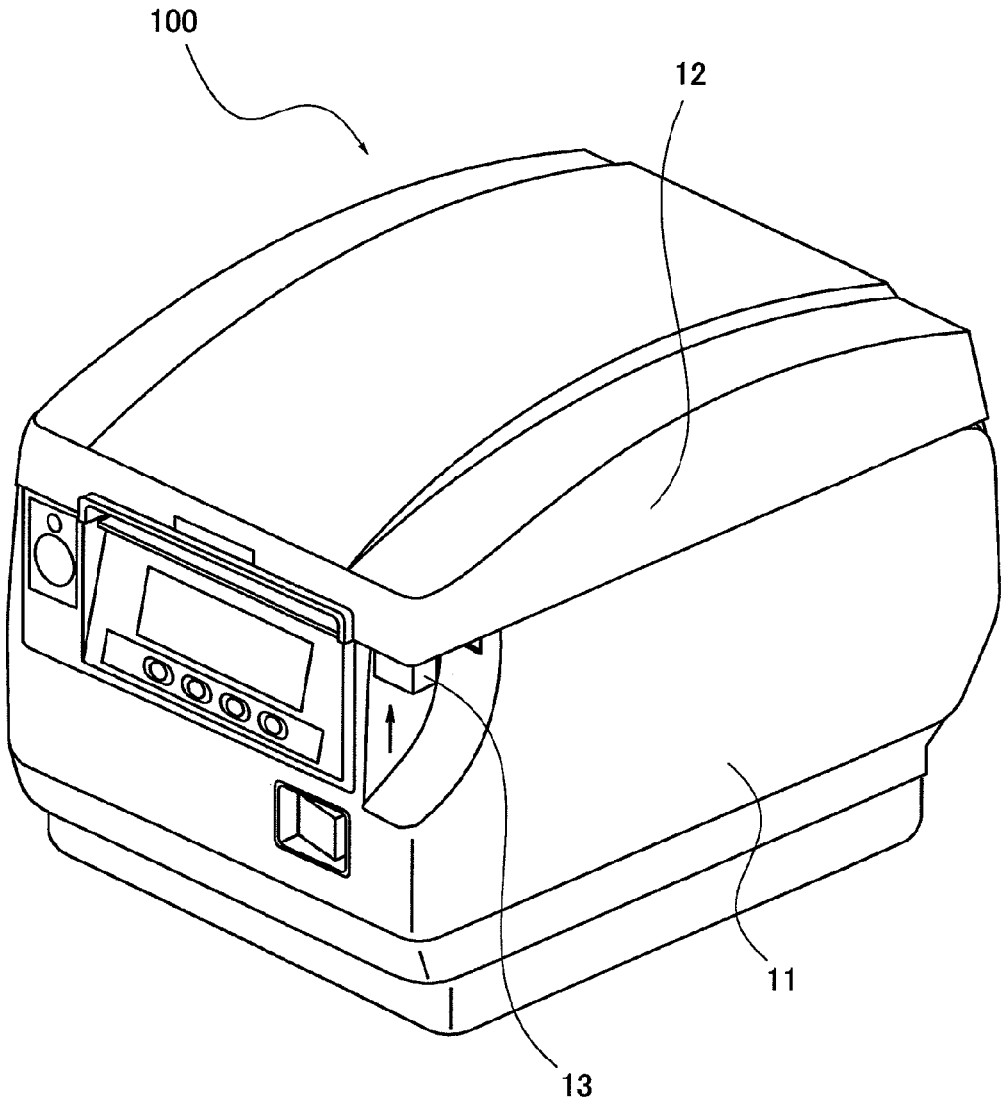
FIG. 1 shows the exterior of a thermal printer in normal use according to one embodiment of the present invention.

A thermal printer according to an embodiment of the present invention has a damper which is combined with a head cover disposed closest to a thermal printhead so that a distance from the damper and the thermal printhead is reduced and a paper container is disposed close to the thermal printhead so that an entire size of the thermal printer, especially a length in a front-back direction, that is, a paper feeding direction is reduced.

That is, the thermal printer according to an embodiment of the present invention has a configuration in which the damper to press a paper fed on a paper feeding path is combined with the head cover disposed on the paper feeding path and configured to partially cover the thermal printhead.

According to such a configuration of the thermal printer of an embodiment of the present invention, the head cover partially covering the thermal printhead is disposed closest to the thermal printhead.

Then, the damper is pressed on the paper fed on the paper feeding path between the thermal printhead and the paper container to provide a predetermined tension on the paper. The damper is combined with the head cover so that the damper can be disposed closest to the thermal printhead.

Accordingly, the thermal printer may have a configuration in that the paper container is disposed close to the damper and therefore the thermal printhead is disposed close to the paper container, so that the entire size of the thermal printer, especially the length in a front-end direction can be reduced.

Since the damper is disposed close to or adjacent to the thermal printhead, a dimensional accuracy between the damper and the thermal printhead can be easily improved.

Further, if the head cover itself is disposed removably from a body or a cover element, the damper is also removable with the head cover. Therefore, even when an elastic force or repulsion force of an elastic member such as a spring, or the like configured to fulfill a function of the damper is weakened or degraded, the spring can be easily replaced.

The head cover may have a guide function for smoothly guiding the paper toward the thermal printhead in addition to partially covering the thermal printhead.

In the thermal printer according to an embodiment of the present invention, the paper container is configured to house a roll of paper rolled in a roll as the paper to be fed. The damper has a damper plate rotatably supported on an upstream end of the head cover in a paper feeding direction as an axis to be turned relative to the head cover within a rotatable range and a turning bias member configured to bias the damper plate in one rotational direction within the rotatable range. The damper plate is preferably disposed on the paper feeding path so as to allow a surface directed in the biasing direction of the turning bias member to be in contact with the paper.

The roll of paper as a paper is pulled out to be used in the thermal printer from an outer-most circumference part. A roll diameter is large at a beginning of use and then becomes small at an end of use, that is, when only small amount of the roll remains.

According to the thermal printer of an embodiment of the present invention, since the configuration is used in that the thermal printhead is disposed close to the paper container so that the damper is disposed closest to the outer-most circumference of the roll of paper with the roll of paper having the largest diameter unused.

As a result, angle between a line connecting a position where the paper is released from the roll and the head cover, that is, a part of the paper, which passes over the roll and the head cover and is pressed by the damper, and a guiding plane (substantially flat plane) of the paper on the head cover is largely changed according to the remaining amount of the paper in the roll.

As described above, in the thermal printer using the roll of paper, in which the damper is disposed between the thermal printhead and the paper container and the thermal printhead is disposed close to the paper container, the changed amount of the angle may attain about 90 degrees according to the remaining amount of the paper in the roll.

In such a thermal printer, since an orientation of the part of the paper passing over the roll and the head cover is largely changed, by the damper configured to press the paper along a direction on a linear line, it is not possible to appropriately provide burden of a pressing force on the paper.

However, according to the thermal printer having the preferred configuration of an embodiment of the present invention, the damper plate providing the burden of the pressing force on the paper is rotatably disposed about the upstream end of the head cover in the paper feeding direction as an axis to be turned relative to the head cover. Therefore, even when the orientation of the part of the paper passing over the roll and the head cover is changed at about the angle of 90 degrees, the damper plate is turned so as to follow the changed orientation so that the pressing force, that is, a bias force by the turning bias member is appropriately continuously provided on the paper in the roll regardless of the remaining amount of the paper.

In the thermal printer according to an embodiment of the present invention, the head cover preferably has a paper detection mechanism configured to detect the paper passing the paper feeding path.

According to the thermal printer having such a preferable configuration, since the paper detection mechanism is provided on the head cover, the paper detection mechanism is not required to be independently provided on another part and therefore the entire size can be more reduced than that in the thermal printer having the configuration in that the paper detection mechanism is independently provided on the paper feeding path between the thermal printhead and the paper container.

Hereinafter, an embodiment of the present invention will be described in detail with reference to the accompanying drawings.

FIG. 1 shows the exterior of a thermal printer 100 in normal use according to one embodiment of the present invention. The thermal printer 100 comprises a body 11 and a cover element 12 which is rotated around the back end of the body 11 from upward to backward to open, as shown in FIG. 2.

Figure 2:
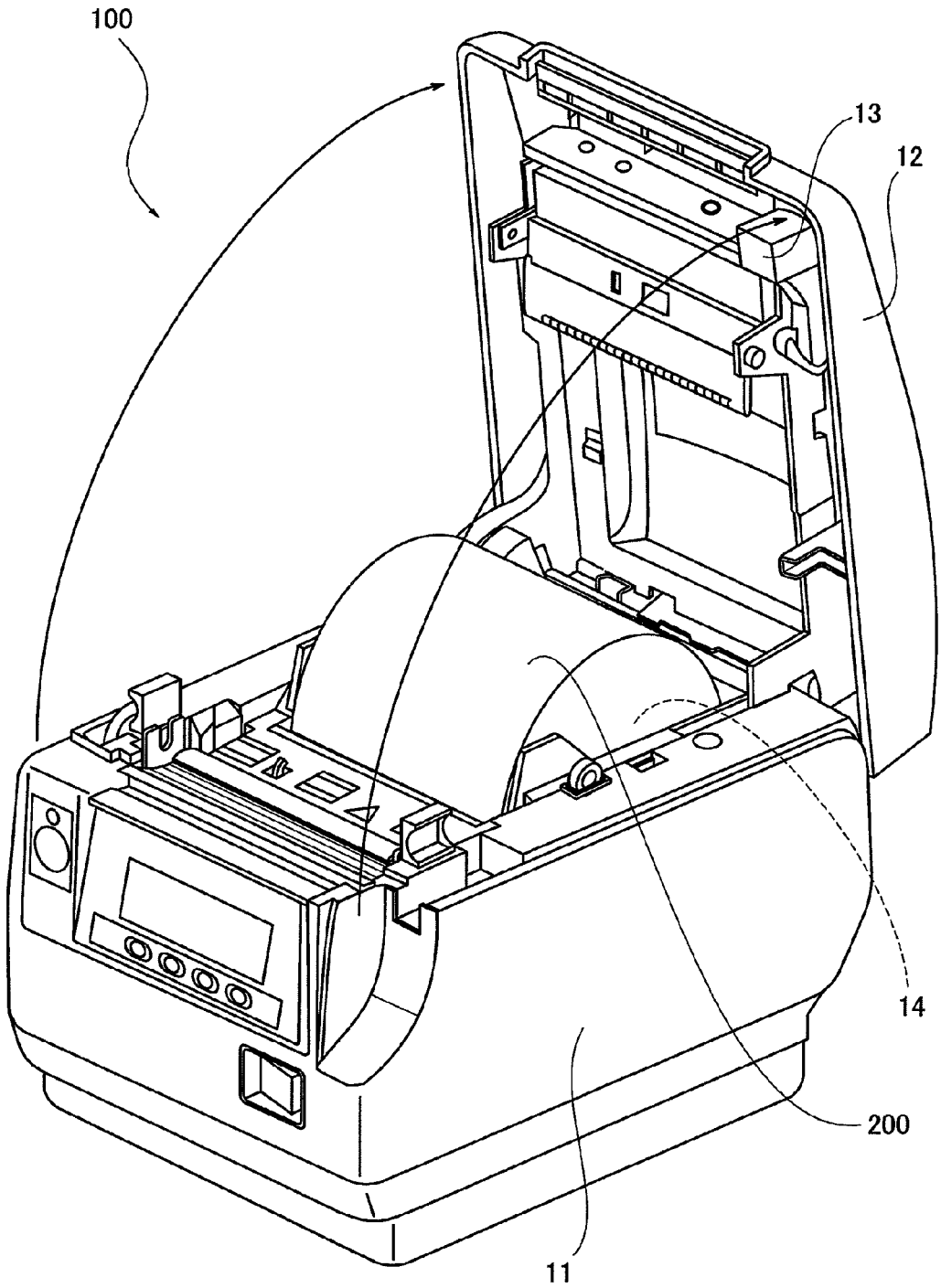
FIG. 2 shows the thermal printer in FIG. 1 with a cover element open.

The cover element 12 is biased to an open position by a not-shown coil spring in FIG. 2 while it is retained in a closed position against the bias force of the coil spring by a not-shown hook of the body 11 fitted into the cover element 12 in FIG. 1.

The hook of the body 11 is removed from the cover element 12 by pressing a lever 13 of the cover element 12 to the arrow direction (upward) in FIG. 1, thereby moving the cover element 12 to the open position by a bias force of the coil spring in FIG. 2.

Figure 3:
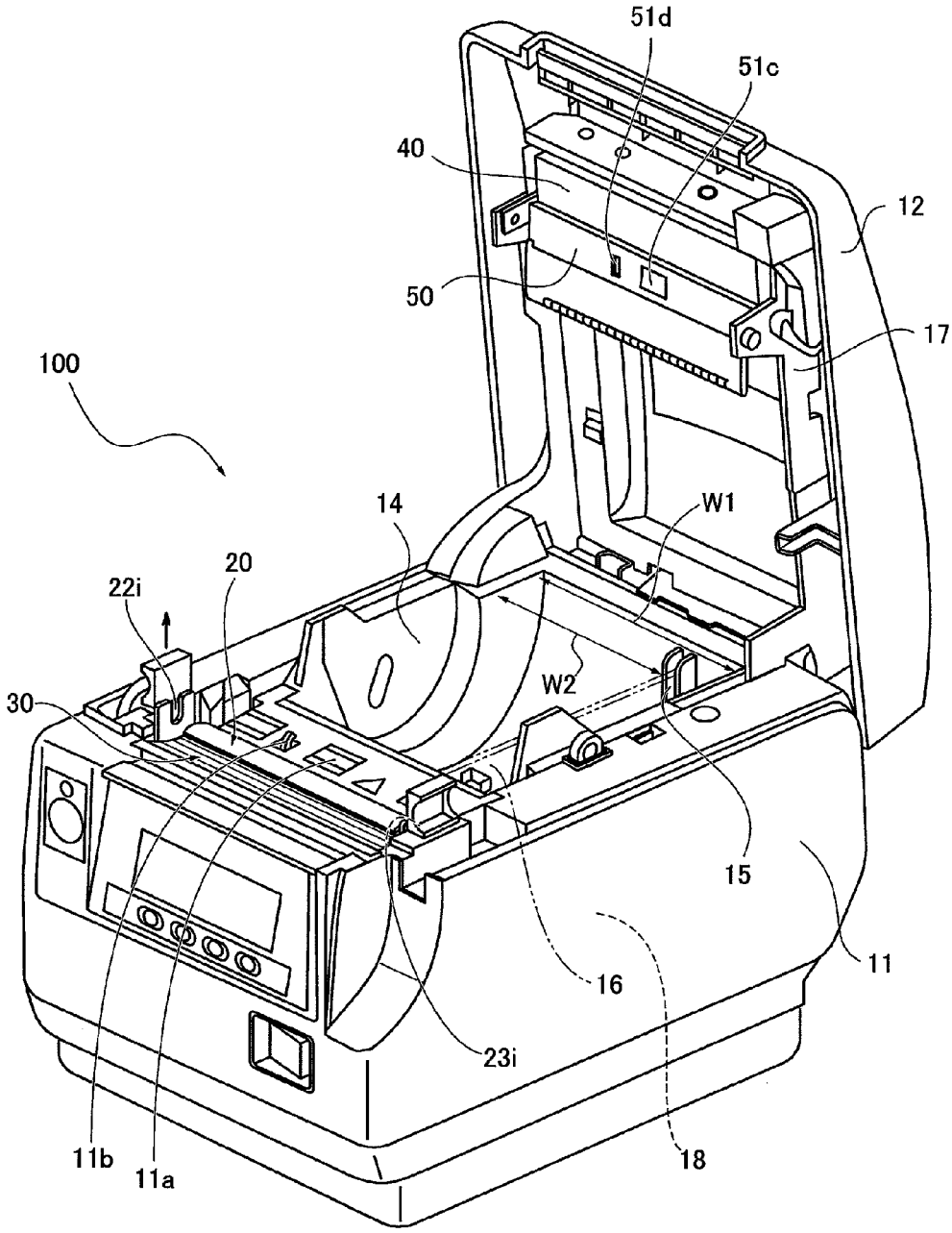
FIG. 3 shows the thermal printer in FIG. 2 with a thermal paper removed.

As shown in FIG. 2, the thermal printer 100 comprises a paper container 14 in which a roll of thermal paper 200 as a printing medium is accommodated. FIG. 3 shows the thermal printer 100 without the thermal paper 200.

The paper container 14 includes a plate groove 15 at a predetermined position in a width direction to support a detachable partition plate 16 of an almost half-round shape (indicated by double-dashed lines in FIG. 3).

While the partition plate 16 is held in the plate groove 15, a space having a narrow width W2 (FIG. 3) from one sidewall is usable in the paper container 14 to accommodate a thermal paper 200 with a narrow width W2. Meanwhile, while the partition plate 16 is not held in the plate groove 15, a space having a wide width W1 (FIG. 3) from one sidewall to another is usable in the paper container 14 to accommodate a thermal paper 200 with a wide width W1. Thus, the width of the thermal paper 200 for use can be selected in accordance with use/non-use of the partition plate 16.

That is, the width of the thermal paper 200 to be used can be selected in accordance with detachment or attachment of the partition plate 16.

The body 11 further comprises a platen roller unit 20 and a cutter unit 30 detachably.

Being pulled up in the arrow direction (upward in FIG. 3, the moving direction of the cover element 12 from the closed position), the platen roller unit 20 and the cutter unit 30 can be detached from the body 11. Attachment of the platen roller unit will be described later in detail.

The cover element 12 detachably comprises a thermal printhead unit 40 including a later-described exothermic element array 42 and a head cover damper unit 50.

The thermal printhead unit 40 and the platen roller unit 20 are configured so that, with the cover element 12 in a closed position, the exothermic element array 42 contacts a later-described platen roller 21 of the platen roller unit 20 while, with the cover element 12 moved from the closed position to an open position, the exothermic element array 42 and the platen roller 21 are separated from each other.

An outer package of the thermal printer according to the present embodiment is made of a resin, and a framework thereof is made of a metal. The thermal printhead unit 40 and head cover damper unit 50 are mounted on a cover frame 17 of the cover element 12 and manually detachable without any tool.

Figure 4:
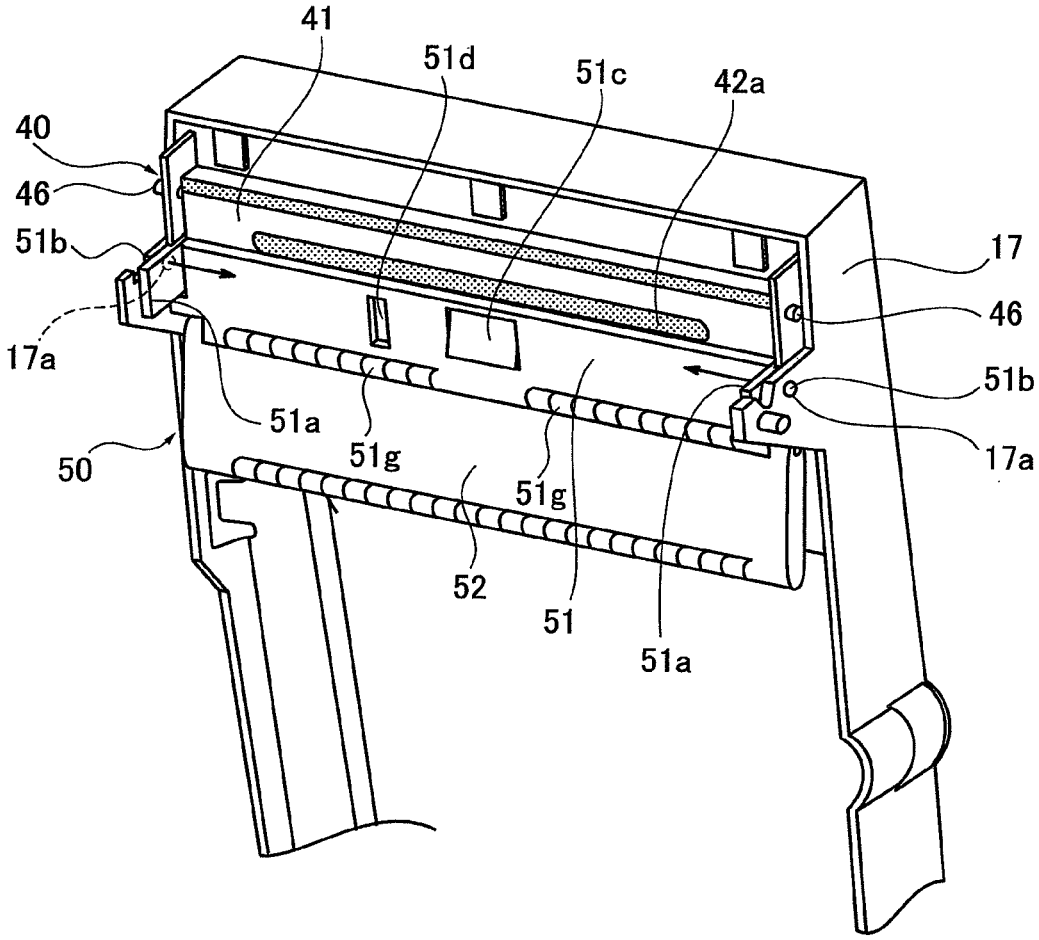
FIG. 4 shows a frame of the cover element to which a thermal printhead unit and a head cover damper unit are attached.

Specifically, the thermal printhead unit 40 is mounted on the cover frame 17 and the head cover damper unit 50 is then attached to the cover frame 17 so as to partially cover the thermal printhead unit 40 as shown in FIG. 4.

The head cover damper unit 50 is comprised of a head cover 51 or a head cover portion covering a part of the thermal printhead 41 of the thermal printhead unit 40 for protection (see IC cover portion 42*a* in FIGS. 4 and 5A), and a damper portion 52 as the damper applying a tension to the thermal paper 200 by providing the pressing force or bias force on the thermal paper 200. The head cover 51 is combined with the damper portion 52 as a unit.

The head cover 51 comprises, on both sides, two elastic arms 51*a* with protrusions 51*b*, and the protrusions 51*b* are fitted into holes 17*a* formed in predetermined positions of the cover frame 17 to attach the head cover damper unit 50 to the cover frame 17.

By elastically deforming both of the elastic arms 51*a* internally in the width direction of the head cover damper unit 50, the protrusions 51*a* are released from the holes 17*a*, making it possible to manually detach the head cover damper unit 50 from the cover frame 17 (FIGS. 5A, 5B) without any tool.

The head cover portion 51 of head cover damper unit 50, which is detached from the cover frame 17, is provided with a paper guiding surface 51*e* having a substantially flat surface to smoothly feed the thermal paper 200 between the thermal print head 41 and the platen roller 21 as shown in FIG. 6.

Figure 5A:
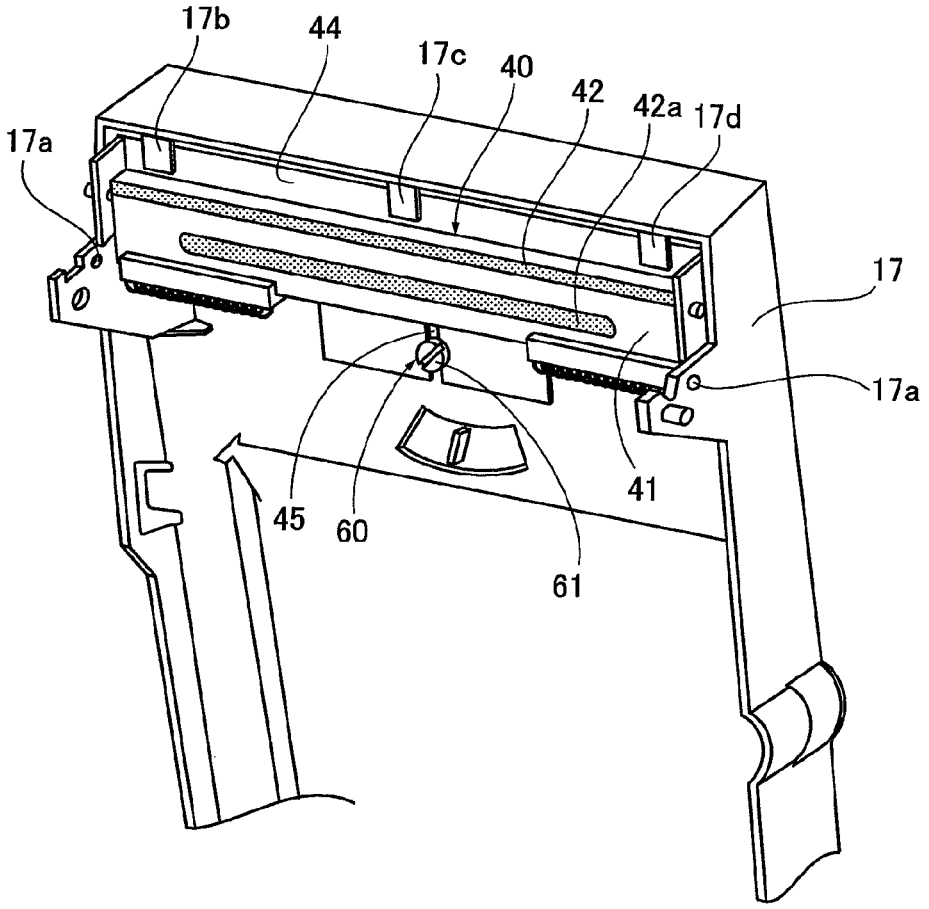
FIG. 5A shows the frame of the cover element with the head cover damper unit removed.
Figure 5B:
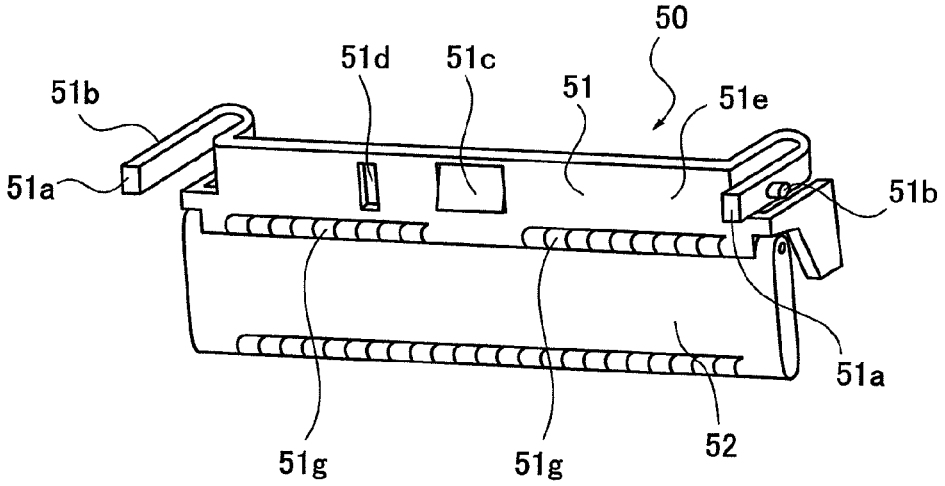
FIG. 5B shows the removed head cover damper unit.

The head cover portion 51 is provided with a photo sensor 51*c* configured to detect light on the paper guiding surface 51*e* and a paper detection lever escaping hole 51*d* (see FIG. 5B).

Here, the body 11 is provided with a light source 11*a* at a part facing the photo sensor 51*c* in a state where the cover element 12 is closed, and a paper detection lever 11*b* (that is, a part of the paper detection mechanism at a part facing the paper detection lever escaping hole 51*d*, and which is also a part of the paper detection mechanism for detecting presence or absence of the paper).

The paper detection lever 11*b* is biased to protrude as shown in FIG. 3. Given a downward load, it is rotated to move down against the bias force. Presence or absence of the thermal paper 200 is determined based on presence or absence of the displacement of the lever 11*b*.

Specifically, with the cover element 12 closed and the thermal paper 200 placed on the paper detection lever 11*b*, the thermal paper 200 presses down the paper detection lever 11*b* and applies a load thereto to rotate down against the bias force. Thereby, presence of the thermal paper 200 is detected.

On the other hand, if the thermal paper 200 is not present on the paper detection lever 11*b*, the paper detection lever 11*b* is fitted in the paper detection lever escaping hole 51*d* formed so as to face the paper detection lever 11*b* and therefore the load is not applied thereto not to rotate down against the bias force. Thereby, absence of the thermal paper 200 is detected.

Such a configuration in that the paper detection mechanism is provided on the head cover portion 51 does not require that the paper detection mechanism is independently provided on another part. Therefore, the entire size can be more greatly reduced than in the thermal printhead having a configuration in which the paper detection mechanism is independently provided on the path of the thermal paper 200 between the thermal printhead 41 and the paper container 14.

Further, with use of a paper on which a thermal label as a printing subject is adhered, the light source 11*a* and the photo sensor 51*c* are provided to distinctly identify a label portion and a paper portion from the paper traveling therebetween.

That is, light emitted from the light source 11*a* partially transmits through the paper and reaches the photo sensor 51*c*. The photo sensor 51*c* is configured to detect intensity of transmitted light and compare the intensity with a preset threshold (a value to distinguish optical intensity having been transmitted through the label portion and one having been transmitted through the paper portion). With the intensity being the threshold or more, the photo sensor 51*a* determines that the paper in question is a paper portion while with the intensity being less than the threshold, it determines that the paper in question is a label portion.

Thus, in thermal printing using a type of paper on which label portions are adhered, it is possible to print not on the paper portions but on the label portions based on information obtained by the light source 11*b* and the photo sensor 51*c* without fail.

Further, the head cover damper unit 50 is detachable from the cover frame 17 as described above and can be manually attached thereto (FIG. 4) without any tool by elastically deforming both of the elastic arms 51*a* internally in the width direction of the head cover damper unit 50 to fit the protrusions 51*a* into the holes 17*a*.

On the other hand, the damper portion 52 is pressed on the thermal paper 200 fed on the path between the thermal printhead 41 and the paper container 14 and as shown in FIG. 6, has a damper plate 52*a*, a support plate 52*c*, a spring 52*b* as the turning bias member disposed between the damper plate 52*a* and the support plate 52*c*, and an idle roller 52*e*. The damper plate 52*a* is rotatably provided about one end and the idle roller 52*e* is rotatably provided at the other end (that is, rotating end) of the damper plate 52*e*.

Although, in the thermal printer 100 according to this embodiment of the present invention, the support plate 52*c* is combined with the head cover portion 51, the support plate 52*c* is functionally configured as a part of the damper portion 52 and therefore may be physically configured as a part of the damper portion 52.

The damper plate 52*a* is supported rotatably about an upstream end 51*f* of head cover 51 with respect to a direction feeding the thermal paper 200 as an axis with an angle θ from about 0 degrees (see FIG. 6B) to 50 degrees (see FIG. 6C) relative to the head cover portion 51.

The spring 52*b* is disposed between the damper plate 52*a* and the support plate 52*c* around a circular arc core bar 52*d* as a guide bar for preventing the spring 52*b* from bending in an unintended direction. With the damper plate 52*a* having the angle of 0 degree (see FIG. 6B), the spring 52*b* is stretched with a predetermined preload applied. With the damper plate 52*a* having the angle of about 50 degrees (see FIG. 6C), the spring 52*b* is compressed and the damper plate 52*a* is biased in a clockwise direction in FIG. 6C by a bias force (pressing force) which is a resultant force of the predetermined preload and an elastic restoring force according to a compressed length.

Figure 6A:
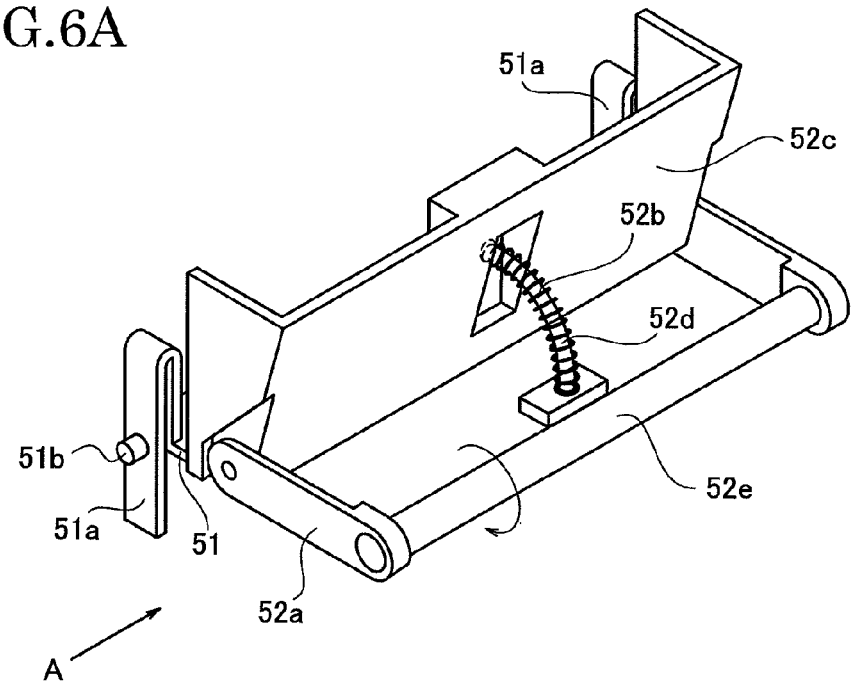
FIGS. 6A to 6C show the structure of the head cover damper unit in detail.
Figure 6B:
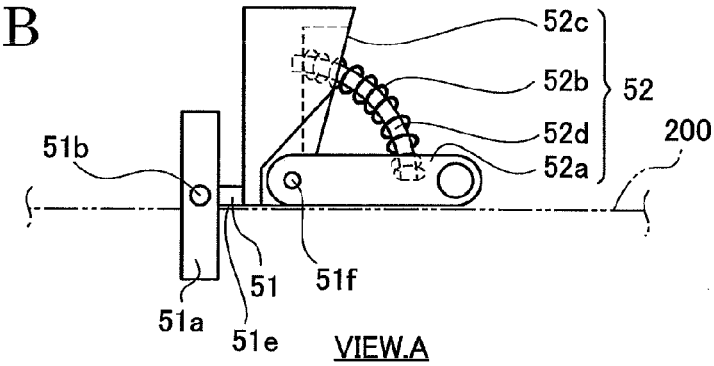
Figure 6C:
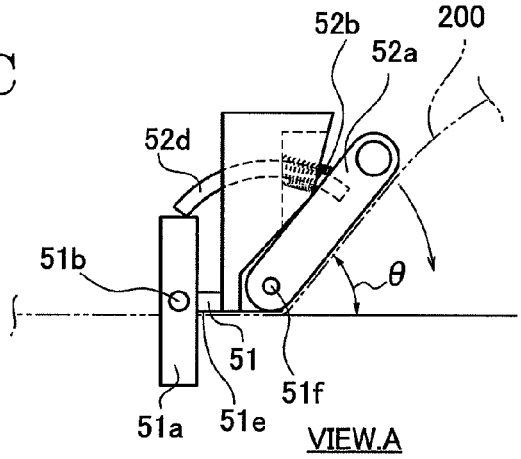

Then, as shown in FIGS. 6B and 6C, the damper portion 52 is disposed on the feeding path of the thermal paper 200 such that the thermal paper 200 shown by a double-dashed line has a contact with a surface of the damper plate 52*a*, which is directed in the bias direction of the spring 52*b* as shown as a lower surface in FIGS. 6B and 6C to press the thermal paper 200 contacting with the lower surface of the damper plate 52*a* so that a tension is applied to the thermal paper 200.

Figure 6D:
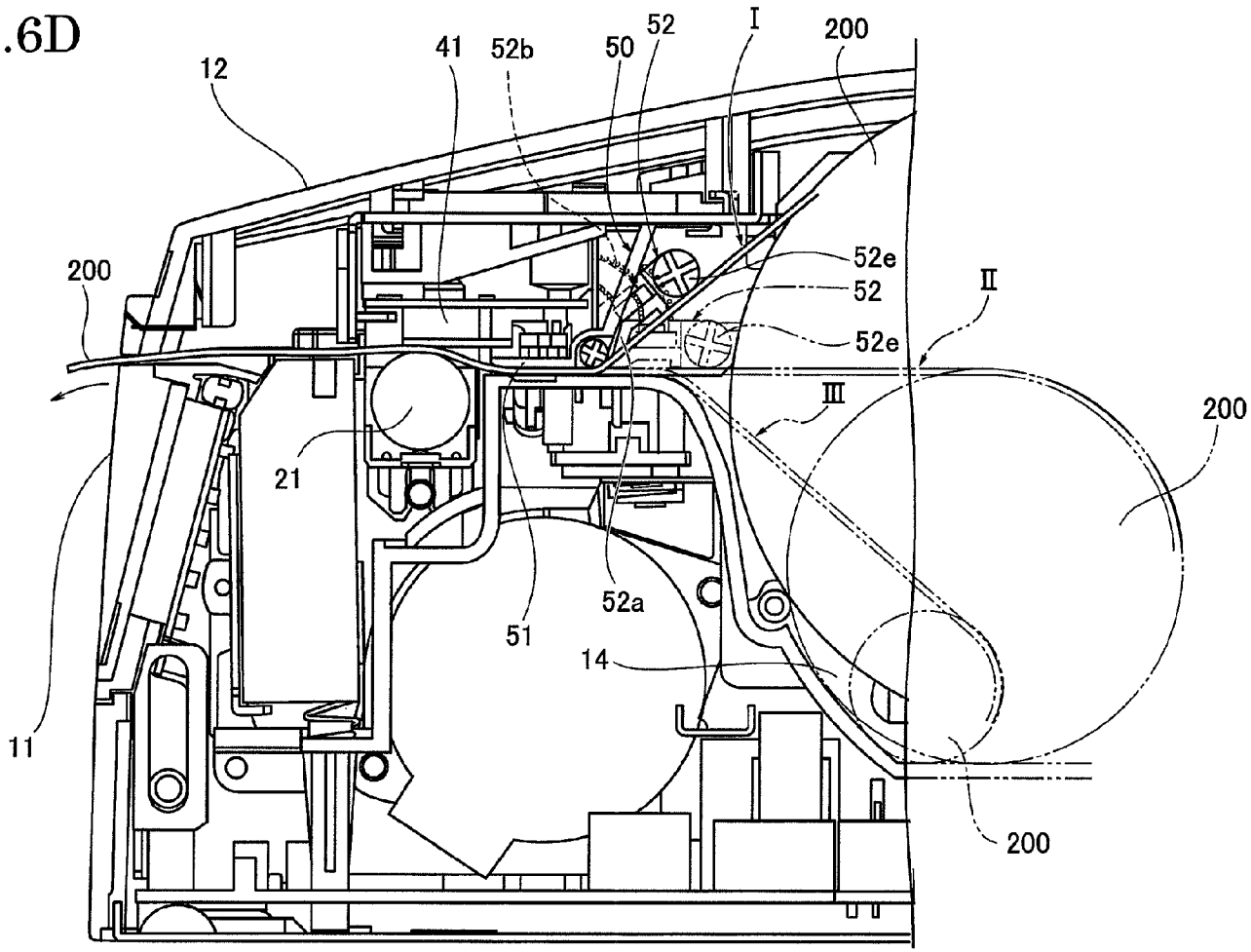
FIG. 6D is a view showing a positional relationship among the thermal print head, a paper container, and a damper unit.

That is, with the roll of the thermal paper 200 having a large diameter due to the large amount of remaining thermal paper, as shown by a solid line in FIG. 6D (see a state indicated by a reference code "I"), a point where the thermal paper 200 starts to be separated or released from the roll is at an upper position than the head cover portion 51.

At this time, the damper portion 52, that is, the damper plate 52*a* biased by the spring 52*b* runs on a part corresponding to a line connecting the point where the thermal paper 200 starts to be released from the roll and the head cover portion 51, that is, a part of the thermal paper 200 passing over the roll and the head cover portion 51. Thereby, the part of the thermal paper 200 receives the bias force of the damper portion 52 to be in a state where an appropriate tension is applied to the thermal paper 200.

Then, the diameter of the roll is decreased as the thermal paper 200 is used. Therefore, the angle θ between the paper guiding surface 51*e* and the part corresponding to the line connecting the point where the thermal paper 200 starts to be released from the roll and the head cover portion 51 is gradually decreased. During such a time when the angle θ is being decreased, the damper plate 52*a* precisely follows the angle θ to continuously apply the bias force to the part of the thermal paper 200 having the angle θ.

If the point where the thermal paper 200 is released from the roll reaches a plane including the paper guiding surface 51*e* of the head cover portion 51 (as shown in FIG. 6B), the paper guiding surface 51*e* is in a plane including the lower surface of the damper plate 52*a* so that the angle θ becomes zero and then the damper plate 52*a* is not further rotated in the clockwise direction by a not-illustrated stopper.

Then, in such a state, that is, a state shown by a double-dashed line in FIG. 6D, the bias force applied by the damper portion 52 to the part corresponding to the line connecting the point where the thermal paper 200 starts to be released from the roll and the head cover portion 51 becomes smallest. However, the tension is applied to the thermal paper 200 by the smallest bias force.

With the thermal paper 200 further used and with the remaining amount further decreased, the point where the thermal paper 200 starts to be released from the roller is positioned at a lower position than the head cover portion 51 as shown by a dash line in FIG. 6D.

On the other hand, since the damper 52*a* does not have the angle θ of negative values, that is, is not rotated under the horizontal plane by the stopper, the thermal paper 200 is separated from the damper plate 52*a* (that is, in a state indicated by reference code "III"), so that the thermal paper 200 does not receive the bias force by the damper portion 52.

However, as shown by the dash line in FIG. 6D, the roll part of the thermal paper 200 sinks down to a bottom portion of the paper container 14. Accordingly, the roll part is supported by the released part, that is, the thermal paper 200 released from the roll, so that a tension corresponding to a weight of the roll part is applied to the released part of the thermal paper 200.

Accordingly, the thermal paper 200 used in the thermal printer 100 can have an appropriate tension even when the damper portion 52 does not apply the bias force to the thermal paper 200.

Further, the thermal printer 100 has a configuration in that the thermal printhead 41 is disposed close to the paper container 14. Accordingly, the angle θ between the paper guiding surface 51*e* of the head cover portion 51 and the part in the thermal paper 200, which corresponds to the line connecting the point where the thermal paper 200 starts to be released from the roller and the head cover portion 51, that is, the part of the thermal paper 200 passing over the roll and the head cover portion 51 largely changes in accordance with the remaining amount of the thermal paper 200 in the roll.

In such a thermal printer, since the orientation of the part of the thermal paper 200, which passes over the roll and the head cover portion 41, largely changes, the damper portion 52 configured to press the thermal paper along one direction on a straight line cannot appropriately apply the pressing force to the thermal paper.

However, in the thermal printer 100 of this embodiment of the present invention, the damper plate 52*a* applying the pressing force to the thermal paper 200 has a downstream end rotated about the upstream end 51*f* of the head cover 51 with respect to the feeding direction of the thermal paper 200 as the axis with the angle θ relative to the head cover portion 51. Accordingly, even if the orientation of the part of the thermal paper 200 passing over the roll and the head cover portion 51 (shown by two dot chain line in FIGS. 6B and 6C) is changed with the angle of about 50 agrees, the damper plate 52*a* is rotated to follow the change of the orientation of the part of the thermal paper 200.

That is, with the large amount of the remaining thermal paper 200, the diameter of the roll is large so that the damper plate 52*a* is largely rotated with the angle θ nearly equal to 50 degrees (θ≈50 degrees) as shown in FIG. 6C and therefore the tension is applied to the thermal paper 200. On the other hand, with the small amount of the remaining thermal paper 200, the diameter of the roll is small so that the damper plate 52*a* is substantially not rotated with the angle θ nearly equal to zero (θ≈0 degree) and therefore the tension is applied to the thermal paper 200. With an intermediate amount of the remaining thermal paper 200, the damper plate 52*a* is rotated with the angle θ corresponding to the remaining amount of the thermal paper to press the thermal paper 200. Thereby, the damper plate 52*a* can continuously appropriately apply the tension to the thermal paper 200 regardless of the remaining amount of the thermal paper 200.

Furthermore, at a part where the thermal paper 200 fed in contact with the damper plate 52*a* firstly has contact with the damper plate 52*a*, that is, an end edge of the damper plate 52*a*, the idle roller 52*e* is provided. Accordingly, since the idle roller 52*e* is rotated, it is possible to prevent a large friction force between the thermal paper 200 and the idle roller 52*e* from being generated regardless of the angle with which the thermal paper 200 has contact with the idle roller 52*e*.

That is, since, in a configuration in which the idle roller 52*e* is not provided, the end edge of the damper plate 52*a* is not moved, the large friction between the end edge of the damper plate 52*a* and the thermal paper 200 which is fed at various angles is easily generated. This large friction may easily cause paper jams.

At this point, the thermal printer 100 according to this embodiment of the present invention is provided with the idle roller 52*e* at the end edge of the damper plate 52*a* so that the large friction can be prevented from being generated to suppress the generation of the paper jams.

Although it is omitted in FIGS. 6A to 6C, idle rollers 51*g*, 51*g* for reducing friction are provided at the upstream end 51*f* of the head cover portion 51 in the feeding direction of the thermal paper 200, as shown in FIGS. 4 and 5A, similarly to the idle roller 52*e*. Accordingly, friction generated on the thermal paper 200 at a boundary part of the head cover portion 51 and the damper plate 52*a* is suppressed.

As described above, the head cover portion 51 partially covering the thermal printhead 41 is disposed closest to the thermal printhead 41 so that the head cover portion 51 can be disposed closest to the thermal printhead 41.

The damper portion 52 pressed on the thermal paper 200 fed on the paper path between the thermal printhead 41 and the paper container 14 to apply a predetermined tension to the thermal paper 200 is combined with the head cover portion 51 so that the damper portion 52 can be disposed closest to the thermal printhead 41.

Therefore, the configuration with the paper container 14 disposed close to the damper portion 52 to dispose the thermal printhead 41 close to the paper container 14 may be used so that the entire size of the thermal printer 100, especially the length in the front-back direction, can be reduced.

Furthermore, the damper portion 52 is disposed close to the thermal printhead 41 so that the dimensional accuracy with the thermal printhead 42 can be easily improved compared with the thermal printer in which the damper portion is configured to apply the tension to the thermal paper 200 at a position far from the thermal printhead 41.

The head cover portion 51 itself is disposed detachably from the cover element 12 so that the damper portion 52 is detachably disposed with the head cover portion 51. Accordingly, even when the spring 52*b* performing a function of the damper portion 52 is degraded due to fatigue or the like, the spring 52*b* can be easily replaced.

Moreover, as shown in FIG. 5A, the thermal printhead unit 40 comprises, at a front end and in front of the exothermic element array 42, a supported portion 44 to fit into or to be engaged with three claws 17*b*, 17*c*, 17*d* of the cover frame 17, and a notch portion 45 at about the center of a width direction of the cover element 12 and in the back of the exothermic element array 42 to fit into or to be engaged with a step portion 61 of a stepped pin 60 of the cover frame 17. The claws are configured to protrude backward (in the upstream direction with respect to paper feed). The stepped pin 60 extends downward (when the cover element 12 in the closed position) from the cover frame 17 and comprises the step portion 61 at a bottom end.

Figure 7A:
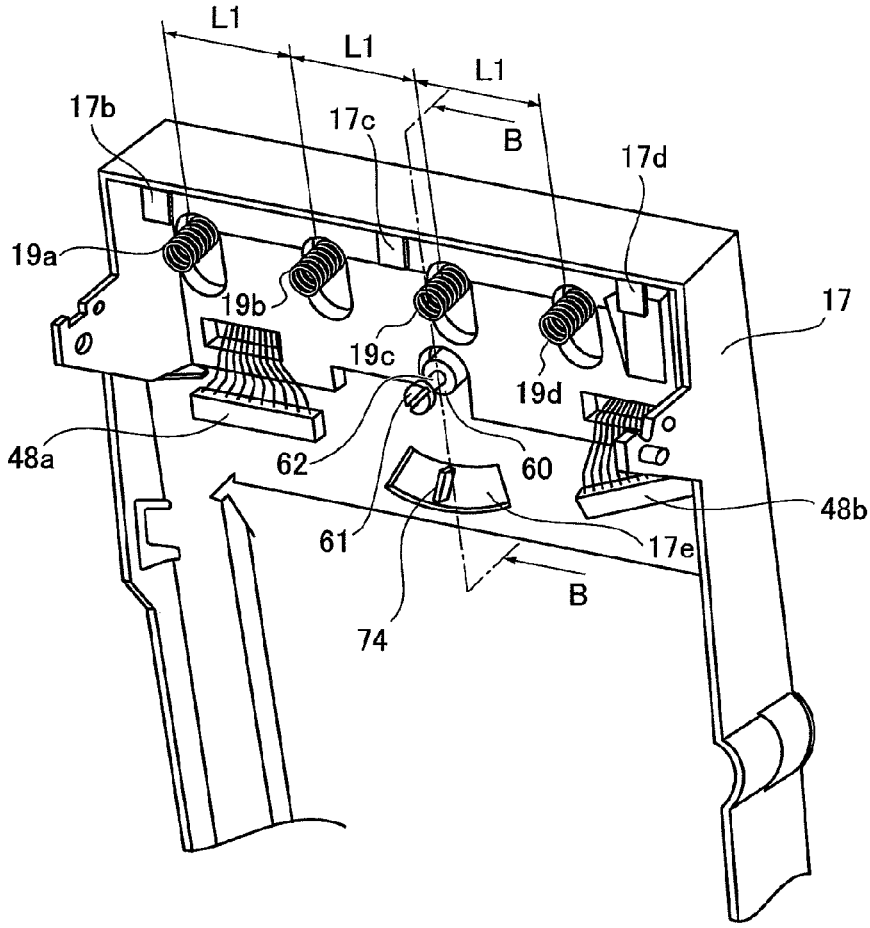
FIG. 7A shows the frame of the cover element with the thermal printhead unit removed additionally.

Specifically, the thermal printhead unit 40 is configured to be manually detachable from the cover frame 17 without any tool by releasing the supported portion 44 from the claws 17*b*, 17*c*, 17*d* and releasing the notch portion 45 from the step portion 61 of the stepped pin 60, as shown in FIG. 7A. Further, the thermal printhead unit 40 includes two terminals 47*a*, 47*b* (FIG. 7B) at both ends connected with the electric connectors 48*a*, 48*b* (FIG. 7A) supplying electric signals, respectively. The terminals 47*a*, 47*b* and the electric connectors 48*a*, 48*b* can be also manually disconnected.

Figure 7B:
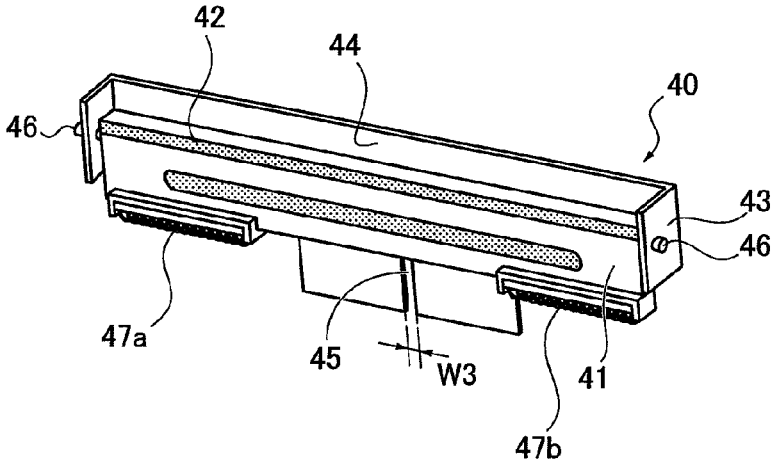
FIG. 7B shows a removed thermal printhead unit.

As shown in FIG. 7B in detail, the thermal printhead unit 40 is comprised of the thermal printhead 41, a head frame 43 attached to the thermal printhead 41, and the supported portion 44 and the notch portion 45 are both formed on the head frame 43.

A width W3 of the notch portion 45 of the head frame 43 is slightly larger than the diameter of a pin portion 62 of the stepped pin 60 and smaller than the diameter of the step portion 61 of the stepped pin 60. Therefore, the pin portion 62 passes through the notch portion 45 but the step portion 61 cannot, so that the periphery of the notch portion 45 is hooked on the step portion 61.

Moreover, the supported portion 44 is also hooked on the claws 17*b*, 17*c*, 17*d*, and four springs 19*a*, 19*b*, 19*c*, 19*d* are disposed between the head frame 43 and the cover frame 17 to generate a bias force to press the supported portion 44 onto the claws 17*b*, 17*c*, 17*d* and press the periphery of the notch portion 45 to the step portion 61.

The four springs 19*a*, 19*b*, 19*c*, 19*d* are disposed on the back of the exothermic element array 42 with the thermal printhead unit 40 attached to the cover frame 17. Because of this, the exothermic element array 42 is properly brought into close contact with a later-described platen roller 21.

In addition, the four springs 19*a*, 19*b*, 19*c*, 19*d* are arranged with an equal interval L1 in the width direction of the thermal paper 200. The interval L1 is set so that the exothermic element array 42 can evenly contact with or be attached to the thermal paper 200 in the width direction irrespective of the width of the thermal paper 200.

That is, with use of the thermal paper 200 in the wide width W1, the bias force of the equally disposed springs 19*a*, 19*b*, 19*c*, 19*d* causes the exothermic element array 42 to be evenly in close contact with the thermal paper 200 in the width direction. Meanwhile, with use of the thermal paper 200 in the narrow width W2, the rightmost spring 19*d* is removed and the bias force of the three springs 19*a*, 19*b*, 19*c* causes the exothermic element array 42 to be evenly in close contact with the thermal paper 200 in the width direction.

Note that to deal with two kinds of paper in the widths W1, W2, the interval L1 can be set to such a value as to be about a highest common factor of the widths W1, W2. For example, the interval L1 is set to 1 inch (about 20 mm) when papers in the wide width W1 of 3 inches (about 80 mm) and the narrow width W2 of 2 inches (about 60 mm) are used. The positions of the four springs 19*a* to 19*d* or the three springs 19*a* to 19*c* are adjusted so that they are almost equally separated from each other from both edges of the thermal paper 200.

Two protrusions 46 as a positioning element are formed on both sides of the head frame 43 along the extension line of the exothermic element array 42, to engage with the platen roller unit 20.

Next, the structure to attach/detach the thermal printhead unit 40 to/from the cover frame 17 will be described with reference to FIGS. 8A to 8D.

Figures 8A, 8B, 8C, 8D:
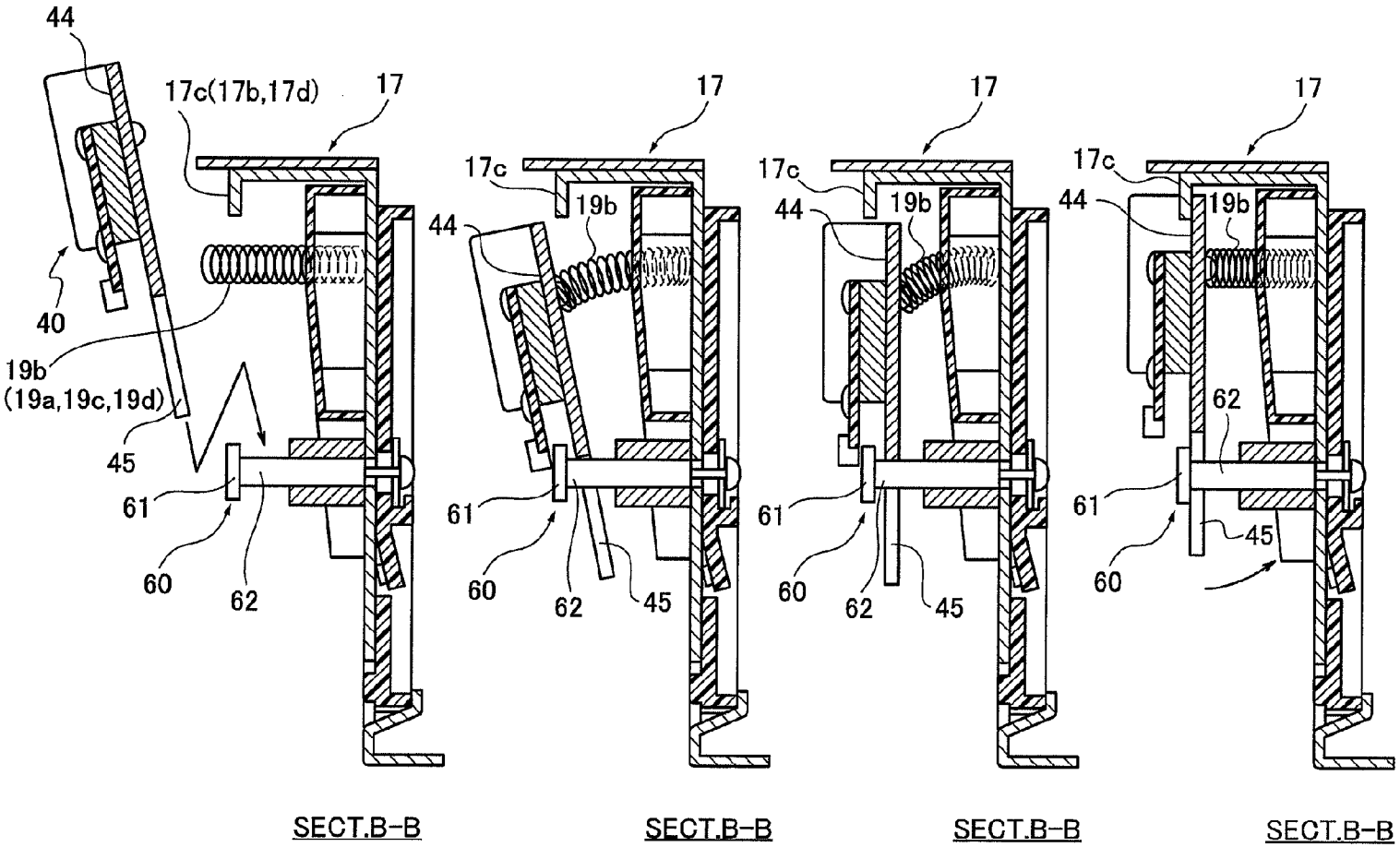
FIGS. 8A to 8D are cross sectional views of the cover frame along the B to B line in FIG. 7A, showing a process in which the thermal printhead unit is attached to the cover frame.

To attach the thermal printhead unit 40 to the cover frame 17 (FIG. 7B), first, the notch portion 45 is inserted into the pin portion 62 of the stepped pin 60 so that the periphery of the notch portion 45 is hooked on the step portion 61 as shown in FIGS. 8A, 8B. Then, while the springs 19*a*, 19*b*, 19*c*, 19*d* contacting with the back face of the head frame 43 (or exothermic element array 42) are contracted, the supported portion 44 is moved to the back side of the claws 17*b*, 17*c*, 17*d* as shown in FIGS. 8B, 8C. Thereafter, the entire thermal printhead unit 40 is moved to the base side of the claws 17*b*, 17*c*, 17*d*, thereby fitting the supported portion 44 into the claws 17*b*, 17*c*, 17*d* as shown in FIG. 8D.

Thus, the thermal printhead unit 40 is attached to the cover frame 17 by the engagement of the supported portion 44 and the claws 17*b*, 17*c*, 17*d* and the engagement of the notch portion 45 and the step portion 61 of the stepped pin 60.

For detaching the thermal printhead unit 40 from the cover frame 17, the above process should be reversed.

As described above, in the thermal printer 100 according to the present embodiment the thermal printhead unit 40 is manually detachable from the cover frame 17 without any tool.

When attached to the cover frame 17, the thermal printhead unit 40 is biased leftward (a direction to approach the platen roller 21 when the cover element 12 is in the closed position) in FIGS. 8A to 8D by the springs 19*a*, 19*b*, 19*c*, 19*d*. However, the thermal printhead unit 40 can be inclined vertically in a traveling direction of the thermal paper 200 when the thermal printer 100 is in normal use with the cover element 12 closed since the front and back ends (portions upper and lower than the exothermic element array 42) thereof are movable rightward (a direction to be separated from the platen roller 21 when the cover element 12 is in the closed position).

Further, the notch portion 45 from the back edge to the front of the head frame 43 is configured to have a length longer than an engaging portion of the claws 17*b*, 17*c*, 17*d* and the supported portion 44 in a front-back direction (vertically in FIGS. 8A to 8D). Therefore, for attaching the thermal printhead unit 40 to the cover frame 17, the notch portion 45 is first inserted into the stepped pin 60 and hooked on the step portion 61 thereof. Then, with the insertion maintained, the thermal printhead unit 40 is moved backward (downward in the drawings) so that the stepped pin 60 is positioned at the base of the notch portion 45. Thereafter, the front end (top end in the drawings) of the thermal printhead unit 40 is moved to the back side (right side) of the claws 17*b*, 17*c*, 17*d* of the cover frame 17, to move the thermal printhead unit 40 forward (upward) by the engaging portion of the claws 17*b*, 17*c*, 17*d* and the supported portion 44. Thereby, the front end of the thermal printhead unit 40 is hooked on the claws 17*b*, 17*c*, 17*d* and the back part thereof is hooked on the stepped pin 60.

Thus, the thermal printhead unit 40 can be easily attached to the cover frame 17 manually without any tool.

Similarly, the thermal printhead unit 40 can be easily detached from the cover frame 17 manually without any tool by performing the above process reversely.

Figure 9A:
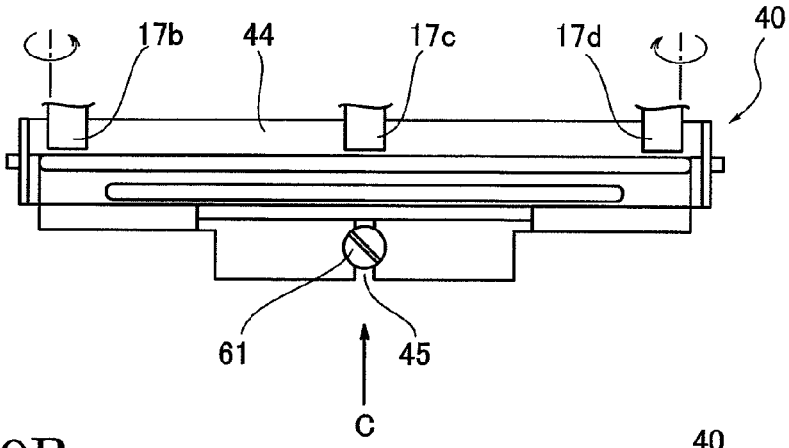
FIGS. 9A to 9D show the thermal printhead unit attached to the cover frame vertically inclining in a width direction.
Figure 9B:
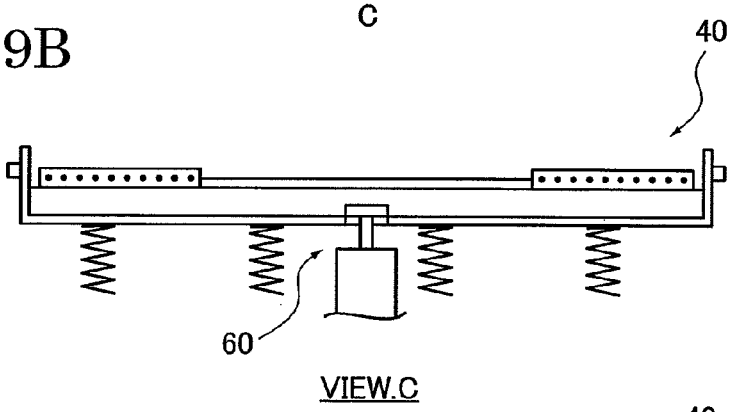
Figure 9C:
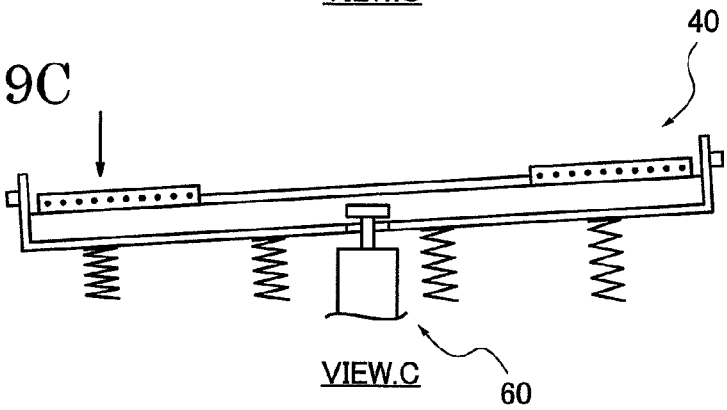
Figure 9D:
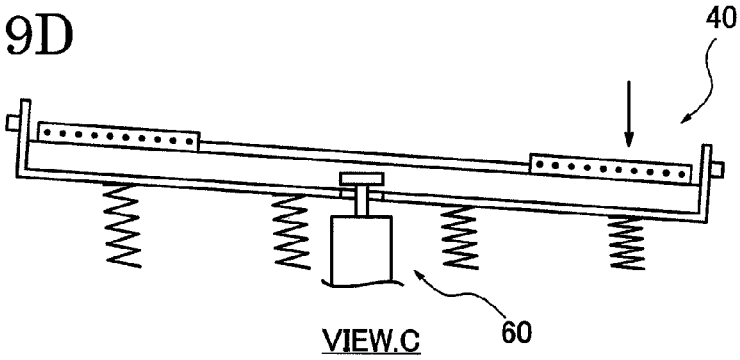

Furthermore, as shown in FIGS. 9A, 9B, the back portion of the thermal printhead unit 40 is supported by only one position (notch portion 45) at about the center of the width direction. Because of this, the thermal printhead unit 40 has the degree of freedom of vertically inclining around the supported portion (about the center of the portion hooked on the step portion) in the width direction as shown in FIGS. 9C, 9D.

An uneven abrasion such as a conic abrasion may occur in a contact portion of the platen roller 21 with the exothermic element array 42 of the thermal printhead unit 40 in the width direction. However, the thermal printhead unit 40 is configured to be inclined in the width direction so that it can negate a difference in the surface of the platen roller 21 due to the uneven abrasion. Thereby, the exothermic element array 42 can be made to contact with the platen roller 21 evenly.

Figure 10:
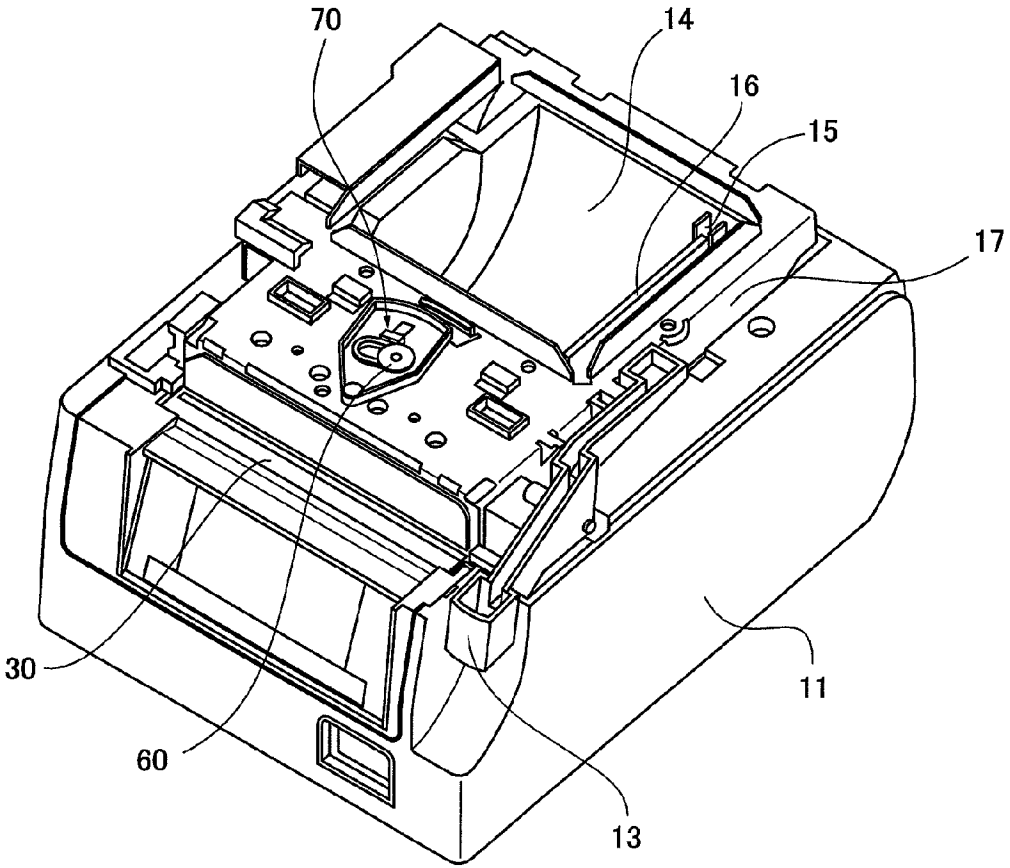
FIG. 10 is a perspective view of the thermal printer in FIG. 1 with an outer package (resin made) of the cover element removed.

FIG. 10 shows the thermal printer with an outer package of the cover element 12 removed therefrom when the cover element 12 is in the closed position.

The cover frame 17 comprises a stepped pin adjuster element 70 which axially moves the stepped pin 60 fitted into the notch portion 45 of the thermal printhead unit 40 to vertically change the position of the step portion 61.

Figure 11A:
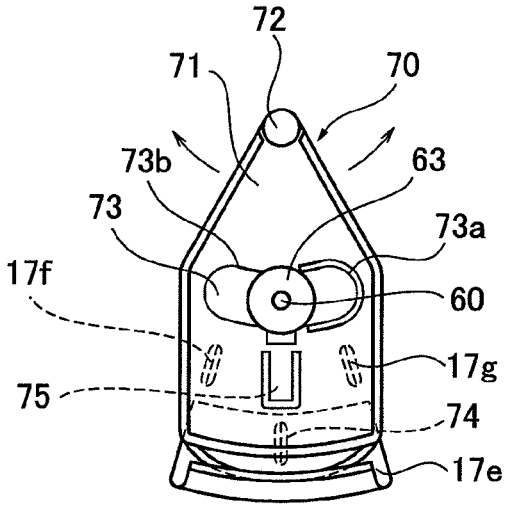
FIG. 11A shows a stepped pin adjuster element seen from the outside of the cover frame in FIG. 10
Figure 11B:
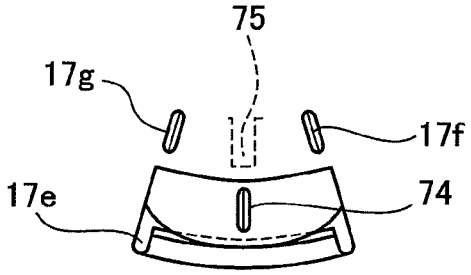
FIG. 11B shows the same with the cover element in an open position seen from the inside of the cover frame.

The stepped pin adjuster element 70, as shown in FIGS. 11A, 11B, is configured of a substantially pentagon-shaped movable plate 71 and supported by a pin 72 to be rotatable therearound. The movable plate 71 includes a long opening 73 extending in the rotary direction through which the stepped pin 60 is inserted. It is movable in the extending direction of the long opening 73 with the stepped pin 60 inserted.

The long opening 73 comprises a rim 73*a* in an uneven thickness. One portion of the rim 73*a* from the center to one movable area (right side in FIG. 11A) is larger in thickness than the movable plate 71. The other portion thereof in the other half of the movable area (left side in FIG. 11A) including the center is equal in thickness to the movable plate 71. The long opening 73 can function as a cam owing to a difference in thickness of the rim.

For convenience, the other portion of the rim 73*a* whose thickness is equal to that of the movable plate 71 is referred to as a thin rim 73*b*.

Further, a tongue-like piece with a protrusion 75 on a back face (facing the cover frame 17) is provided in the vicinity of the long opening 73 of the movable plate 71. The protrusion 75 is configured to fit into concavities 17*f*, 17*g* of the cover frame 17 on both ends of the movable (rotatable) area when the movable plate 71 is moved in the movable area with the stepped pin 60 inserted through the long opening 73. This allows an operator to feel the movable plate 71's hitting the both ends as well as prevents the movable plate 71 with the protrusion fitted into either of the concavity 17*f*, 17*g* from unnecessarily moving.

Moreover, as in FIG. 11B showing the back side of FIGS. 7, 11A, the movable plate 71 includes a window 17*e* in a portion corresponding to the outer circumference of the cover frame 17. The window 17*e* extends along the movable area of the movable plate 71 to allow the back face of the outer circumference of the movable plate 71 to be exposed. On the exposed portion of the movable plate 71 provided is a protrusion 74 to allow an operator to place a finger thereon to rotate the exposed movable plate 71 around the pin 72.

The stepped pin 60 comprises, at a top end, a flat washer 63 as a large diameter portion whose diameter is larger than that of the stepped pin 60. When protruding from the long opening 73, the flat washer 63 is hooked on the rims 73*a*, 73*b* as a cam. When hooked on the thick rim 73*a* by the rotation of the movable plate 71, the flat washer 63 is pulled up to the front side of FIG. 12A by a difference in thicknesses of the rims, 73*a*, 73*b*. This also moves the stepped pin 60 joined with the flat washer 63 to the front side of the drawing, that is, in the axial direction of the stepped pin 60. Meanwhile, when hooked on the thin rim 73*b*, the flat washer 63 may not move.

Figure 12A:
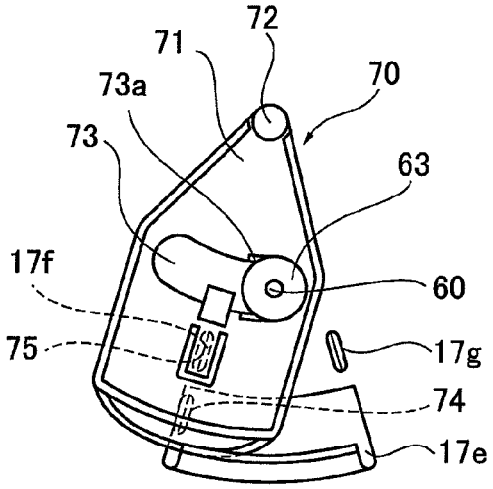
FIGS. 12A to 12C show an inclined thermal printhead in accordance with a position of the stepped pin adjuster element for a thick thermal paper in FIGS. 11A, 11B, FIG. 8, respectively.
Figure 12B:
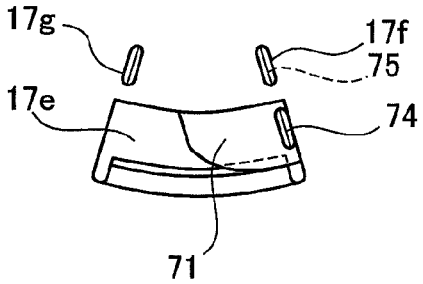

This movement is described with reference to FIGS. 12A to 12C, 13A to 13C. First, as shown in FIG. 12B, an operator places a finger on the protrusion 74 exposed from the window 17*e* to inside of the cover frame 17 to move the protrusion 74 to the right end of the drawing. As shown in FIG. 12A, the movable plate 71 is rotated around the pin 72 to the left side and the flat washer 63 of the stepped pin 60 inserting through the long opening 73 is hooked on the thick rim 73*a* of the long opening 73.

At the same time, the protrusion 75 is fitted into the concavity 17*f* of the cover frame 17. Thereby, the operator can feel the completion of the rotary operation of the movable plate 71. Also, the movable plate 71 can be prevented from unnecessarily moving.

Figure 12C:
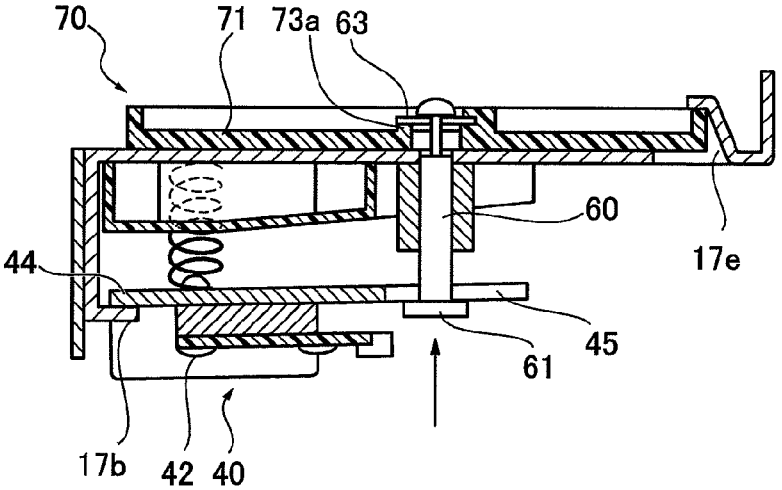

The flat washer 63 is moved up by a difference in thickness between the rims 73*a*, 73*b* in FIG. 12C (cover element 12 in the closed position), which moves the stepped pin 60 joined with the flat washer 63 (in FIG. 12C) upwardly.

The step portion 61 at the bottom end of the stepped pin 60 is also moved up. Accordingly, the notch portion 45 of the thermal printhead unit 40 is moved up, and the posture of the thermal printhead unit 40 is inclined counterclockwise by an amount of the upward movement of the notch portion 45.

Figure 13A:
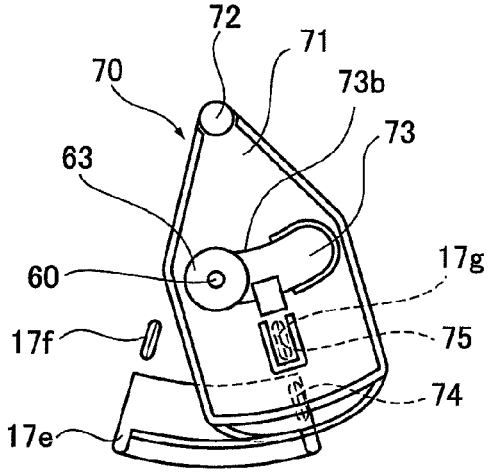
FIGS. 13A to 13C show an inclined thermal printhead in accordance with a position of the stepped pin adjuster element for a thin thermal paper in FIGS. 11A, 11B, FIG. 8, respectively.
Figure 13B:
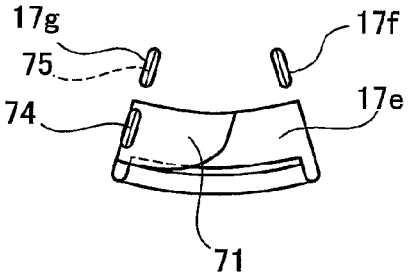

Meanwhile, as shown in FIG. 13B, the operator places a finger on the protrusion 74 exposed from the window 17*e* to inside of the cover frame 17 to move the protrusion 74 to the left end of the drawing. As shown in FIG. 13A, the movable plate 71 is rotated around the pin 72 to the right side and the flat washer 63 of the stepped pin 60 inserting through the long opening 73 is hooked on the thin rim 73*b* of the long opening 73.

At the same time, the protrusion 75 is fitted into the concavity 17*g* of the cover frame 17. Thereby, the operator can feel the completion of the rotary operation of the movable plate 71. Also, the movable plate 71 can be prevented from unnecessarily moving.

Figure 13C:
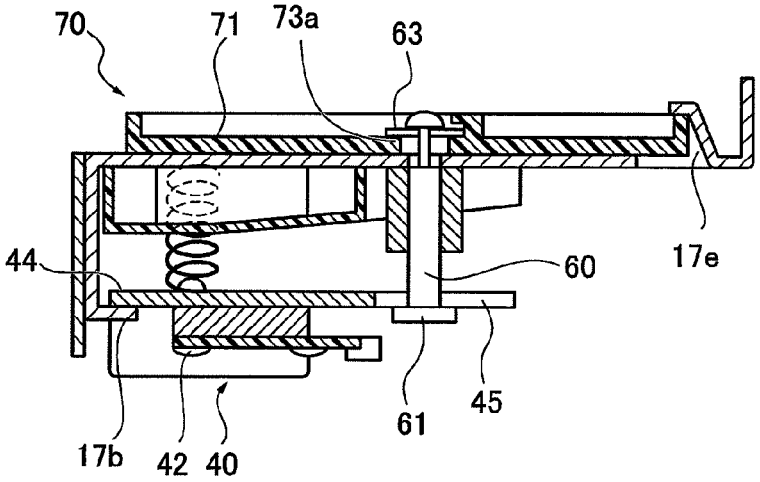

The flat washer 63 is moved down by a difference in thickness of the rims 73*a*, 73*b* in FIG. 13C (cover element 12 in the closed position), which moves down the stepped pin 60 joined with the flat washer 63.

The step portion 61 at the bottom end of the stepped pin 60 (in FIG. 13C) is also moved down. Accordingly, the notch portion 45 of the thermal printhead unit 40 is moved down, and the posture of the thermal printhead unit 40 is inclined clockwise by an amount of the downward movement of the notch portion 45.

Inclination of the thermal printhead unit 40 will be further described in detail after the platen roller unit 20 is described.

Figure 14:
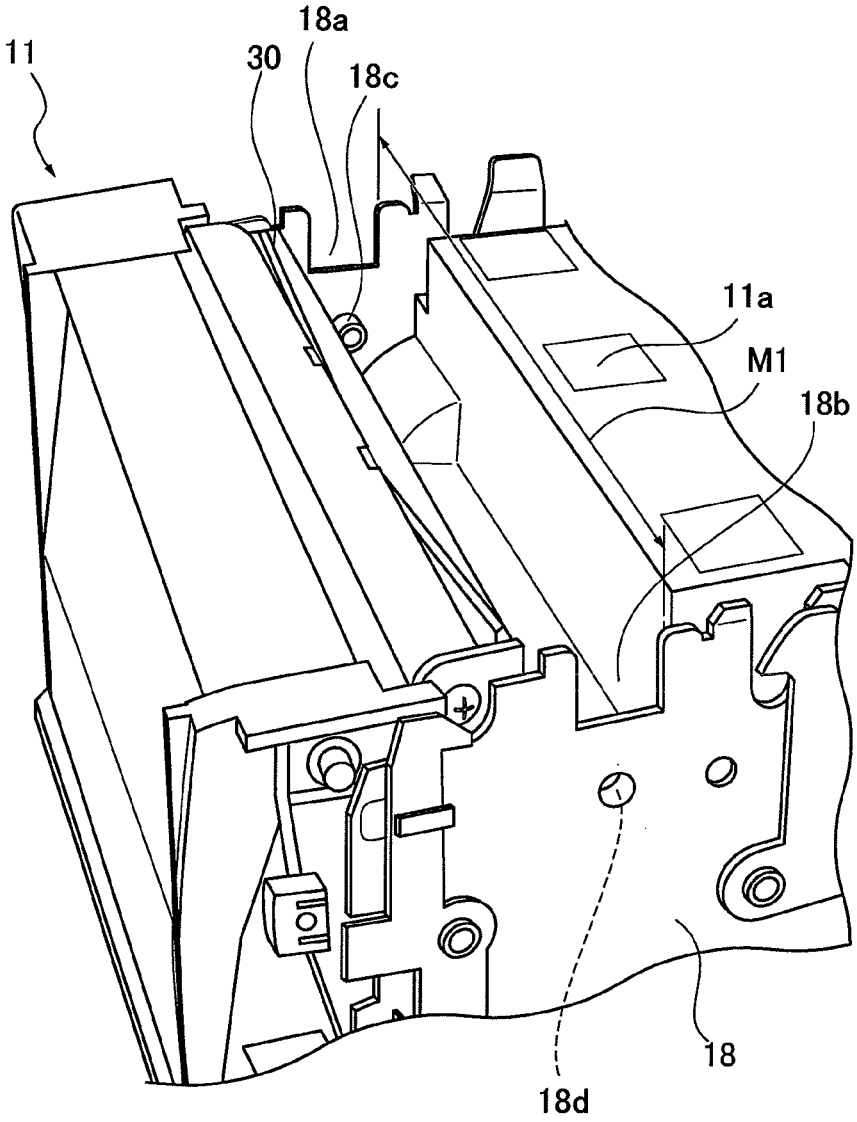
FIG. 14 is a perspective view of a body frame on which the platen roller unit is mounted.

The platen roller unit 20 is attached to a frame 18 of the body 11 in FIG. 14 and disposed in the body 11 in FIG. 3.

Figure 15:
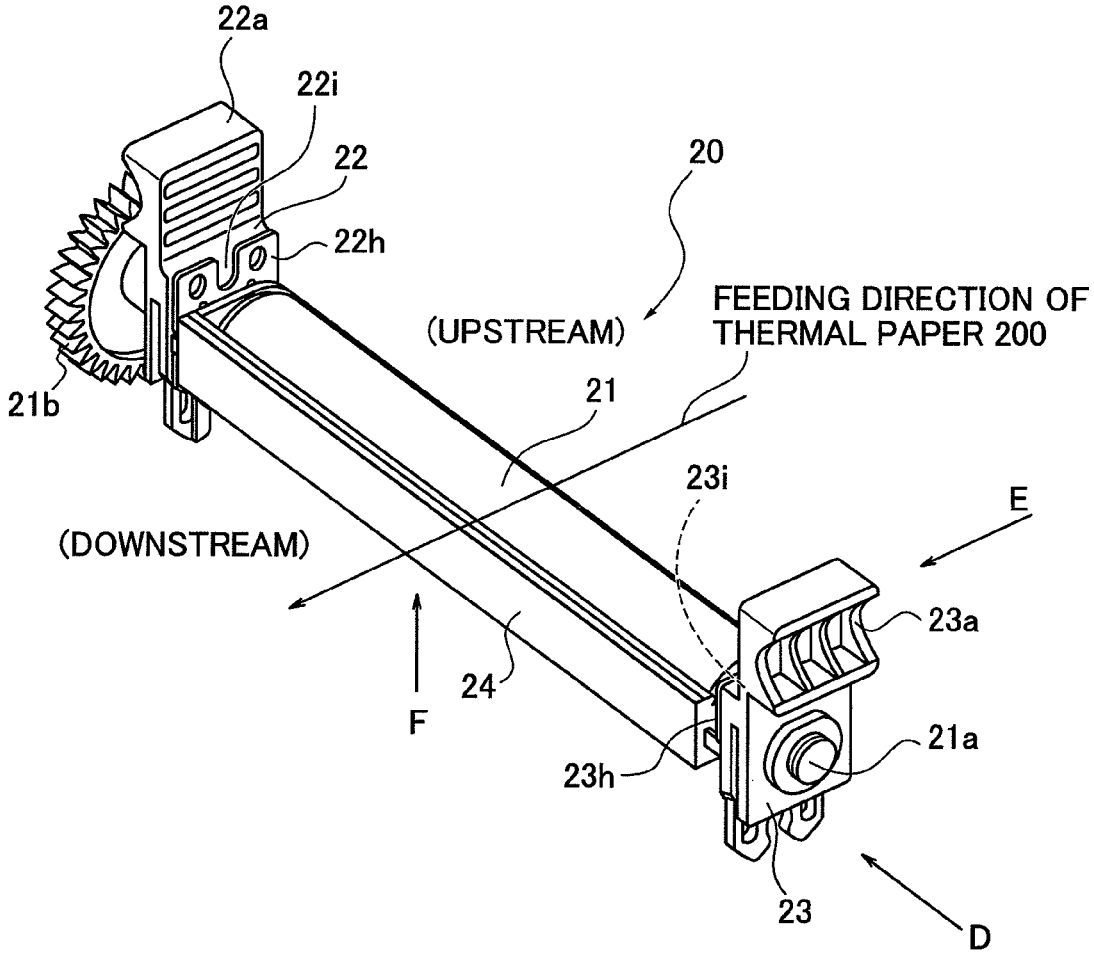
FIG. 15 is a perspective view of the platen roller unit detached from the body frame.

Detached from the body frame 18, the platen roller unit 20 in FIG. 15 comprises a platen roller 21, a rotary shaft 21*a* protruding from both ends of the platen roller 21, support elements 22, 23 rotatably supporting the rotary shaft 21*a*, and a paper separating frame 24 attached to the protruding ends of the rotary shaft 21*a* and the support elements 22, 23 and extending in parallel to the rotary shaft on both (upstream and downstream) sides of the platen roller 21 in the feeding direction of the thermal paper 200.

When the thermal paper is fed between the platen roller 21 and the thermal printhead 41 from the upstream, the paper separating frame 24 functions as a guide to properly pull off the thermal paper 200 from the platen roller 21 and feed it to the downstream as well as to prevent the thermal paper 200 wound around the platen roller 21 from traveling in an unintended direction.

The support elements 22, 23 are the same structures and made of resin elements 22*a*, 23*a* and metal plates 22*h*, 23*h*, respectively.

Figure 16A:
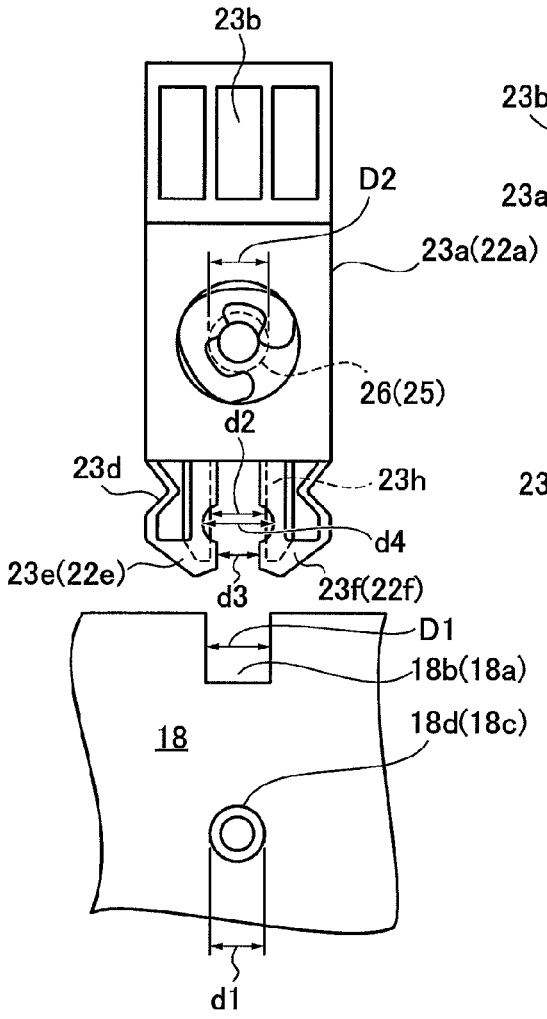
FIGS. 16A, 16B show a support element for the platen roller unit in detail, seen from the arrows D, E in FIG. 15, respectively.
Figure 16B:
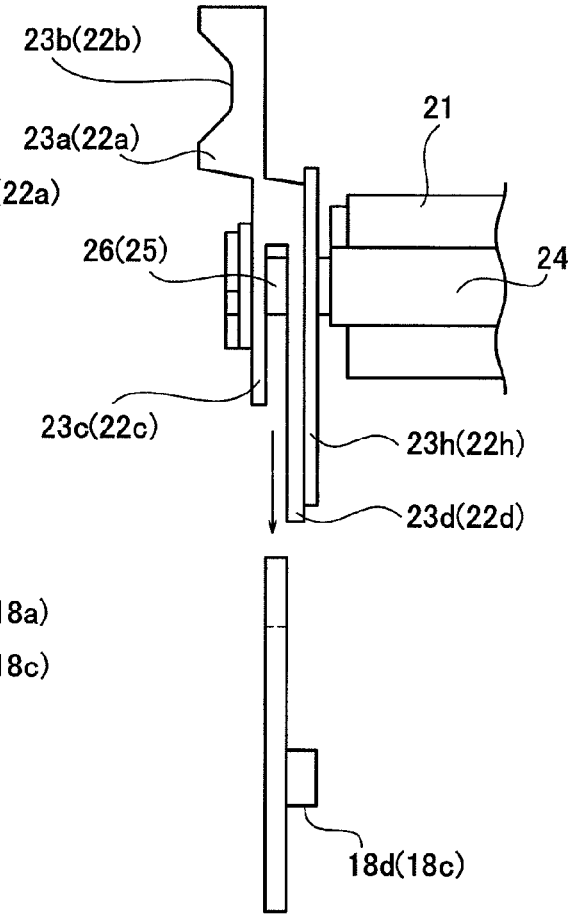

As shown in FIGS. 16A, 16B, the resin elements 22*a*, 23*a* include finger hooks 22*b*, 23*b* on portions higher than the platen roller 21, respectively. The finger hooks 22*b*, 23*b* are configured for an operator to place a finger thereon and pull up the entire platen roller unit attached to the body frame 18 (FIG. 3) (in the same direction as the moving direction of the cover element 12 from the closed position) for detaching the platen roller unit 20 from the body 11.

Also, the resin elements follow the finger hooks 22*b*, 23*b* and are split into two in the width direction of the platen roller 21 to form two leg portions 22*c* (23*c*), 22*d* (23*d*) as shown in FIG. 16B.

The inside leg portions 23*d* (22*d*) are formed to be longer than the outside leg portions 23*c*, (22*c*) and are further split into two to form two legs 23*e* (22*e*), 23*f* (22*f*) as shown in FIGS. 16A, 16B.

The rotary shaft 21*a* of the platen roller 21 protrudes from both ends of the platen roller 21 and the protruding portions penetrate through the outside and inside leg portions 23*c* (22*c*), 23*d* (22*d*). A bearings 26 (25) is provided around a portion of the rotary shaft 21*a* passing through a space between the leg portions 23*c* (22*c*), 23*d* (22*d*) to rotatably support the rotary shaft 21.

Figure 17A:
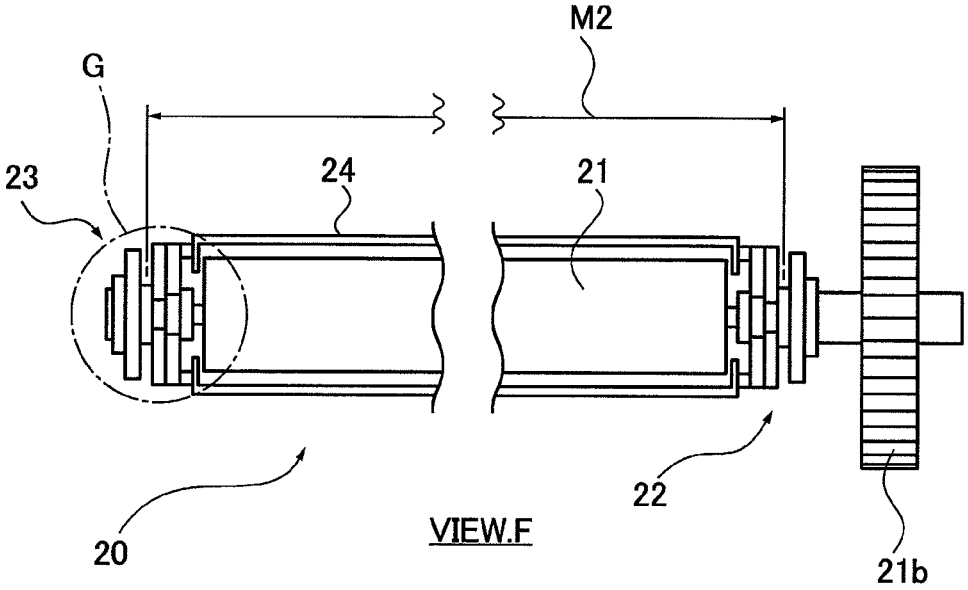
FIG. 17A shows the support element for the platen roller unit in detail, seen from the arrow F in FIG. 15.
Figure 17B:
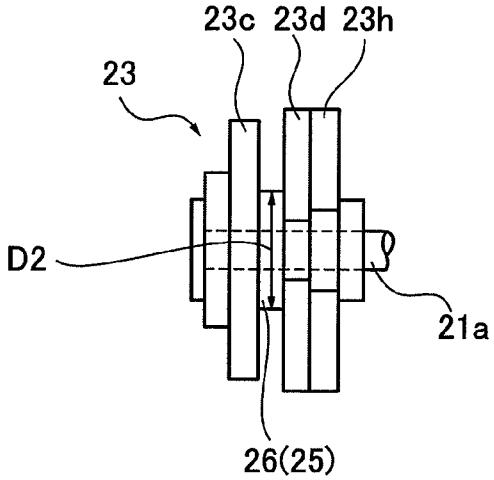
FIG. 17B shows a portion G in FIG. 17A in detail.

Further, the body frame 18 includes a notch 18*b* (18*a*) (to engage with the platen roller) in a width D1 on both sidewalls in the width direction in FIGS. 14, 16A. The width D1 is equal to or slightly larger than the outer diameter D2 of the bearing 26 (25) as shown in FIG. 17B (D2≤D1).

The width between the two leg portions 23*c* (22*c*), 23*d* (22*d*) is set to be slightly larger than the thickness of the body frame 18. A length M2 (in FIG. 17A) from the space between the leg portions 23*c*, 23*d* to that between the other leg portions 22*c*, 22*d* is set to be almost equal to a distance M1 from both sidewalls of the body frame 18 in the width direction (FIG. 14). The platen roller unit 20 is thus attached to the body frame 18 with one sidewall inserted into the space between one of the leg portions 23*c*, 23*d* and the other sidewall inserted into the space between the other one of the leg portions 22*c*, 22*d*.

Moreover, the bearing 26 for the rotary shaft 21*a* passing through the space between the leg portions 23*c*, 23*d* is engaged with the notch 18*b* of the one sidewall of the body frame 18 while the bearing 25 thereof passing through the space between the leg portions 22*c*, 22*d* is engaged with the notch 18*a* of the other sidewall of the body frame 18. Thereby, the platen roller unit 20 is positioned vertically or longitudinally relative to the body frame 18.

The two legs 23*e* (22*e*), 23*f* (22*f*) of the legs portion 23*d* (22*d*) are disposed with gaps d3, d4. The gap d3 between the bottom ends of the legs is narrower than the gap d4 (d3<d4) between the portions above the bottom ends as shown in FIG. 16A.

Further, the metal plates 22*h*, 23*h* of the support elements 22, 23 as shown in FIG. 16B are in close contact with the inner faces of the inside legs 22*d*, 23*d* in the width direction. The metal plates 22*h*, 23*h* are also split into two from portions below the portions through which the rotary shaft 21*a* penetrates. A gap d2 between the two split portions is larger than the gap d3 but smaller than the gap d4 (d3<d2<d4).

Note that the center of the gap d2 between the two split portions and the centers of the gaps d3, d4 between the legs 23*e* (22*e*), 23*f* (22*f*) coincide with one another, and the center of the rotary shaft 21*a* (or bearing 26 (25)) is positioned on the upward extension line of the centers.

Meanwhile, bosses 18*c*, 18*d* in diameter d1 are formed on both of the sidewalls of the body frame 18, to protrude from the sidewalls internally in the width direction. The bosses 18*c*, 18*d* are provided with a distance from the bottom ends of the notches 18*a*, 18*b* corresponding to a distance from the bottom faces of the bearings 25, 26 in which the gap between the legs 23*e* (22*e*), 23*f* (22*f*) becomes d4.

The diameter d1 of the bosses 18*c*, 18*d* is set to be equal to or slightly smaller than the gap d2 of the two split portions of the metal plates 22*h*, 23*h* of the support elements 22, 23. The bosses 18*c*, 18*d* are formed so that the centers of the notches 18*a*, 18*b* are positioned on the vertical line of the centers of the bosses 18*c*, 18*d*, respectively.

Figure 18A:
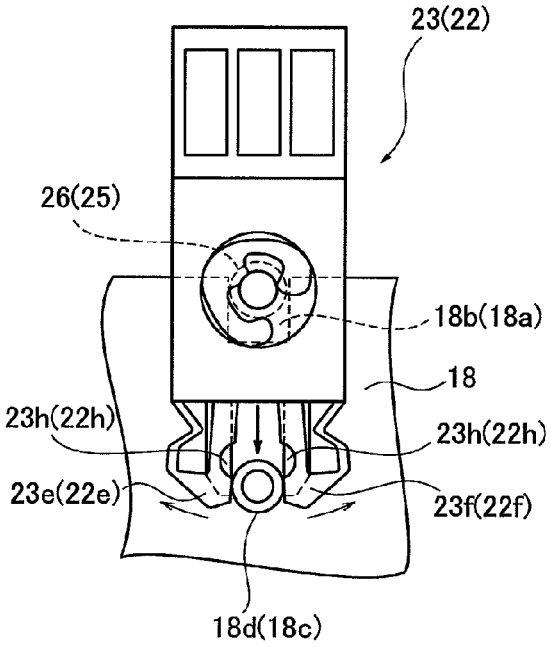
FIGS. 18A, 18B show one example of how the platen roller unit is attached to the body frame, corresponding to FIGS. 16A, 16B, respectively.
Figure 18B:
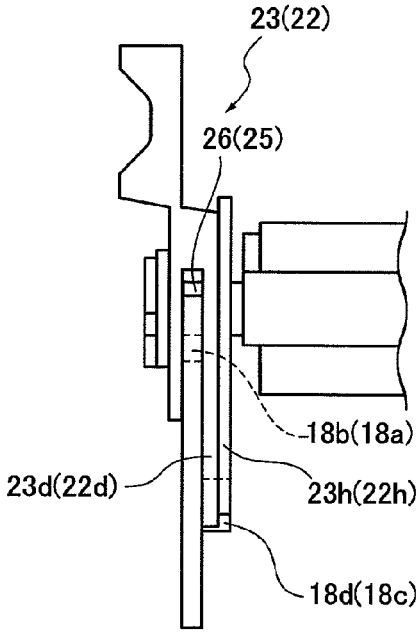

With such a configuration, the platen roller unit 20 is moved down vertically relative to the body frame 18 and attached thereto by engaging the bearing 25 of the platen roller unit 20 with the sidewall notch 18*b* of the body frame 18 as well as the bearing 26 of the platen roller unit 20 with the sidewall notch 18*a* of the body frame 18. Along with the downward movement, the boss 18*d*, (18*c*) is inserted through the gap between the legs 23*e* (22*e*), 23*f* (22*f*) of the support elements 23 (22) as shown in FIGS. 18A, 18B.

The diameter d1 of the boss 18*d* (18*c*) is larger than the gap d3 at the bottom of the legs 23*e* (22*e*), 23*f* (22*f*) of the support elements 23 (22), so that the legs are elastically deformed to expand the gap d3 along with the insertion of the boss 18*d*, (18*c*). According to the present embodiment, the legs are made of resin materials and elastically deformable. However, the present invention is not limited thereto. The legs can be made of thin metal materials.

Meanwhile, the gap d2 between the two split portions of the metal plates 23*h* (22*h*) is equal to or slightly larger than the diameter dl of the boss 18*d* (18*c*) so that the boss 18*d* (18*c*) is moved along the gap without expanding it.

Figure 19A:
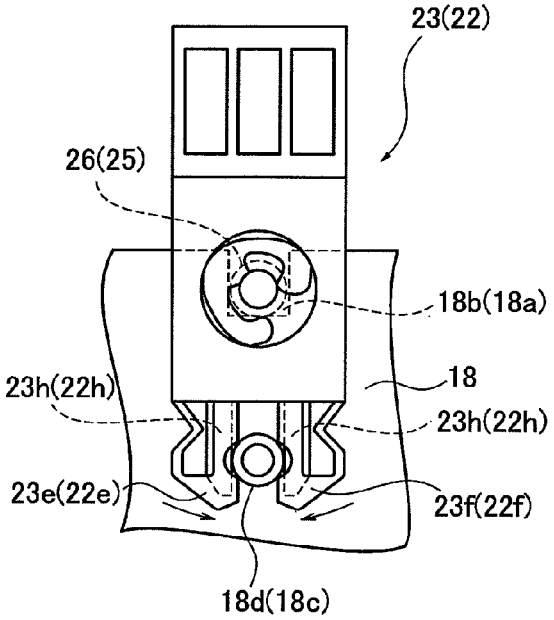
FIGS. 19A, 19B show another example of how the platen roller unit is attached to the body frame, corresponding to FIGS. 16A, 16B, respectively.
Figure 19B:
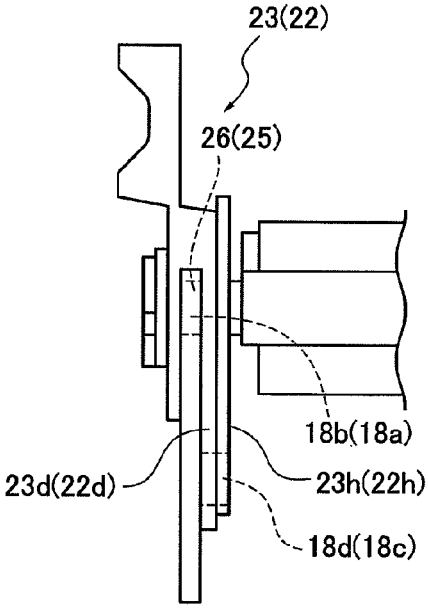

With further downward movement of the platen roller unit 20, as shown in FIGS. 19A, 19B, the bearing 26 of the platen roller unit 20 is fitted into the sidewall notch 18*b* of the body frame 18, and the bearing 25 of the platen roller unit 20 is fitted into the sidewall notch 18*a* of the body frame 18. This stops the downward movement of the platen roller unit 20.

When attached to the body frame 18, a backlash of the platen roller 21 relative to the body frame 18 is preventable since the sidewall notches 18*b*, 18*a* of the body frame 18 are configured to be equal to or slightly larger than the bearings 26, 25 of the platen roller unit 20, respectively.

Furthermore, the boss 18*d* (18*c*) advances and reaches the gap d4 between the two legs 23*e* (22*e*), 23*f*, (22*f*) wider than the gap d2 (≈d1) between the two split portions of the metal plates 23*h*, (22*h*).

Because the gap d4 is larger than the diameter of the boss 18*d* (18*c*), the outer elastic deformation of the two legs 23*e* (22*e*), 23*f*, (22*f*) is eliminated. As a result, the lower part of the boss 18*d* (18*c*) is blocked by the gap d2 narrower than its diameter d1. To move up the platen roller unit 20, the narrow gap d2 need be expanded by the boss 18*d* (18*c*) and a load required for expanding the gap acts as a resisting force against the platen roller unit moving upward. Thus, the platen roller unit 20 can be prevented from unintentionally dropping off from the body frame 18.

In addition, it is possible to prevent the support elements 22, 23 from rotating around the bearings 25, 26 while the platen roller unit 20 is attached to the body frame 18 by the engagement of the bearings 25, 26 and the notches 18*a*, 18*b* of the body frame 18.

Needless to say that an operator can move up the platen roller unit 20 against the resisting force using the finger hooks 22*b*, 23*b* to detach the platen roller unit 20 from the body frame 18. The operator can manually attach/detach the platen roller unit 20 without any tools.

Further, both edges of the gap (boss notch) in the metal plate 23*h* (22*h*) are defined by the metal plate 23*h* (22*h*) of high rigidity. Therefore, the gap between the boss notch in the metal plate 23*h* (22*h*) and the outer diameter of the boss 18*d* (18*c*) can be precisely maintained. Also, the two legs 23*e* (22*e*), 23*f*, (22*f*) holding the boss 18*d* (18*c*) therebetween are a part of the elastic resin element 23*a*. This accordingly makes it possible to easily switch holding the boss 18*d* (18*c*) and detaching the boss 18*d* (18*c*) against the elastic force.

Furthermore, the platen roller unit 20 is configured to be able to engage with the body frame 18 and comprises positioning elements to define the position relative to the thermal printhead unit 4 attached to the cover element 12.

That is, in FIG. 15 positioning notches 22*i*, 22*h* as positioning elements are formed in the top parts of the metal plates 22*h*, 23*h* of the support elements 22, 23 of the platen roller unit 20.

These positioning notches 22*i*, 23*i* are fitted into protrusions 46 on both sides of the head frame 43 of the thermal printhead unit 40 in FIGS. 4, 7B with the cover element 12 in the closed position (FIGS. 1, 10), to restrict relative movement of the exothermic element array 42 of the thermal printhead unit 40 and the platen roller 21.

Figure 20:
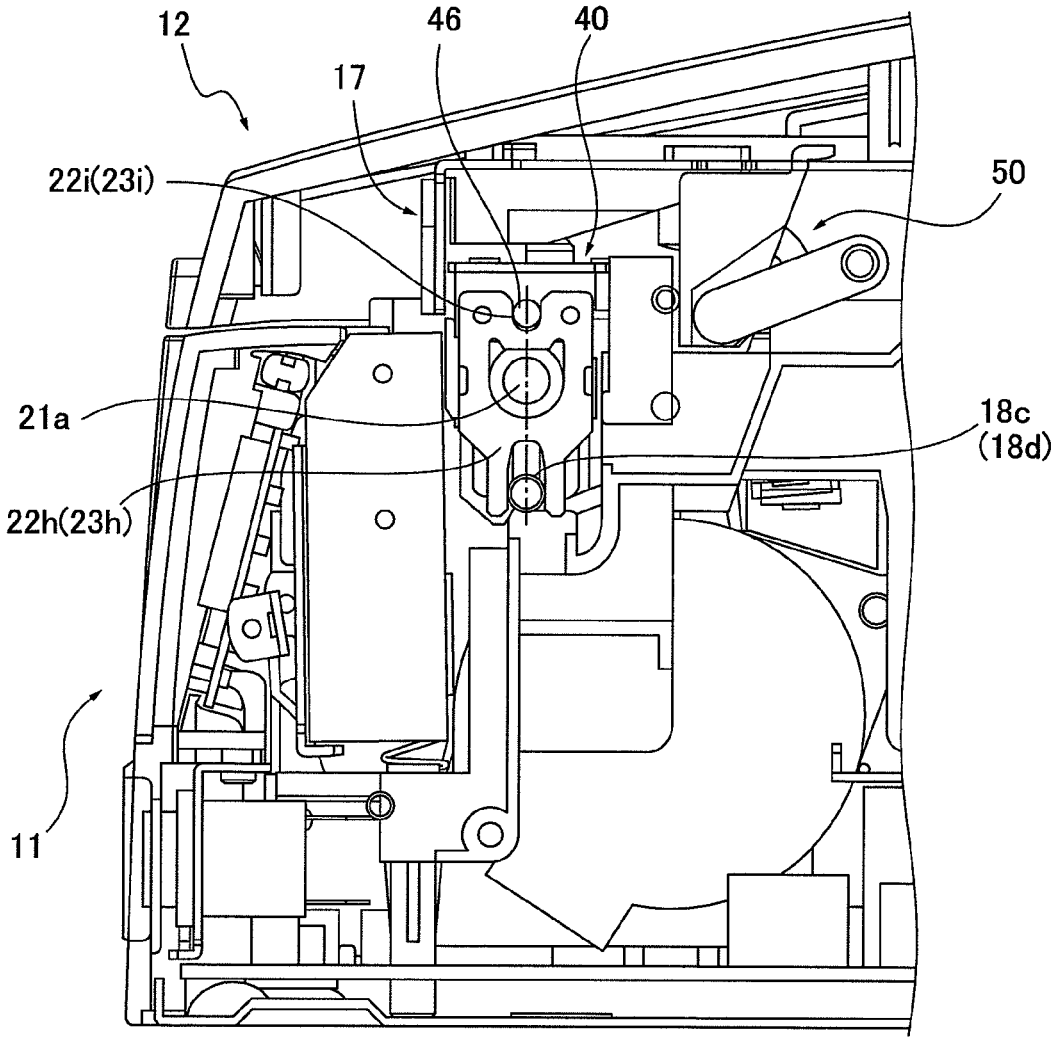
FIG. 20 is a perspective view of the essential elements when a protrusion of the thermal printhead unit engages with a positioning notch of the platen roller unit.

The positioning notches 22*i*, 23*i* are formed in the metal plates 22*h*, 23*h*, respectively so that their centers are positioned on a straight line connecting the center of the rotary shaft 21*a* and the center of the gap of the two split portions of the metal plates 22*h*, 23*h*, as shown in FIG. 20.

Therefore, with the cover element 12 in the closed position, one of the protrusions 46 of the thermal printhead unit 40, the center of the rotary shaft 21*a*, and the boss 18*c* of the body frame 18 are aligned on a single straight line on one sidewall of the body frame 18 (FIG. 20) while the other protrusion 46, the center of the rotary shaft 21*a*, and the boss 18*d* of the body frame 18 are aligned on a single straight line on the other sidewall of the body frame 18.

The platen roller unit 20 is detached from the body 11 by pulling it up in the same direction (upward in the drawings) as the moving direction of the cover element 12 from the closed position. With the cover element 12 closed, the platen roller unit 20 can be firmly fixed to the body 11 and prevented from erroneously detached since the protrusions 46 of the thermal printhead unit 40 attached to the cover element 12 are engaged with the positioning notches 22*i*, 23*i* of the platen roller unit 20.

Further, as shown in FIGS. 12A to 12C, 13A to 13C, the inclination (to the feeding direction of the thermal paper 200) of the thermal printhead unit 40 is adjustable by manipulating the movable plate 71 of the stepped pin adjuster element 70 to change the position of the step portion 61 of the stepped pin 60.

However, in the above description referring to FIGS. 12A to 12C, 13A to 13C, the thermal printhead unit 40 is inclined while the movement thereof is restricted by the cover frame 17 via the claws 17*b*, 17*c*, 17*d*, stepped pin 60, and springs 19*a* to 19*d*. With the cover element 12 in the closed position, the protrusions 46 of the thermal printhead unit 40 are engaged with the positioning notches 22*i*, 23*i*, and the exothermic element array 42 of the thermal printhead unit 40 and the platen roller 21 contact with each other, so that the exothermic element array 42 moves up against a bias force of the springs 19*a* to 19*d* to compress the springs 19*a* to 19*d*.

Here, the thermal printhead unit 40 moves around the notch portion 45 hooked on the step portion 61, but the movement thereof is restricted to the rotation around the protrusions 46 and upward movement along the positioning notches 22*i*, 23*i* of the platen roller unit 20 by the engagement of the protrusions 46 and the positioning notches 22*i*, 23*i*.

Therefore, the inclination (posture) of the entire thermal printhead unit 40 is defined by the rotation around the protrusions 46 while the vertical position (around the notch portion 45) of the back part thereof is defined by the position of the step portion 61 adjusted by the stepped pin adjuster element 70.

Figure 21A:
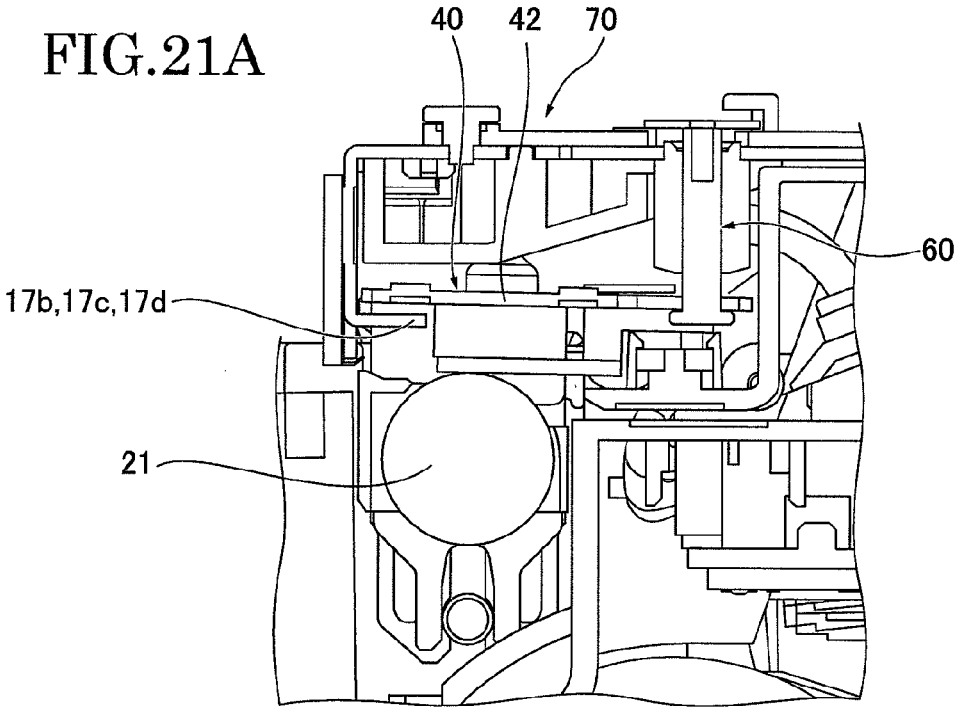
FIG. 21A shows the thermal printhead unit inclined along with a thick thermal paper and FIG. 21B shows the same inclined along with a thin thermal paper when the thermal printhead unit and the platen roller unit are positioned.
Figure 21B:
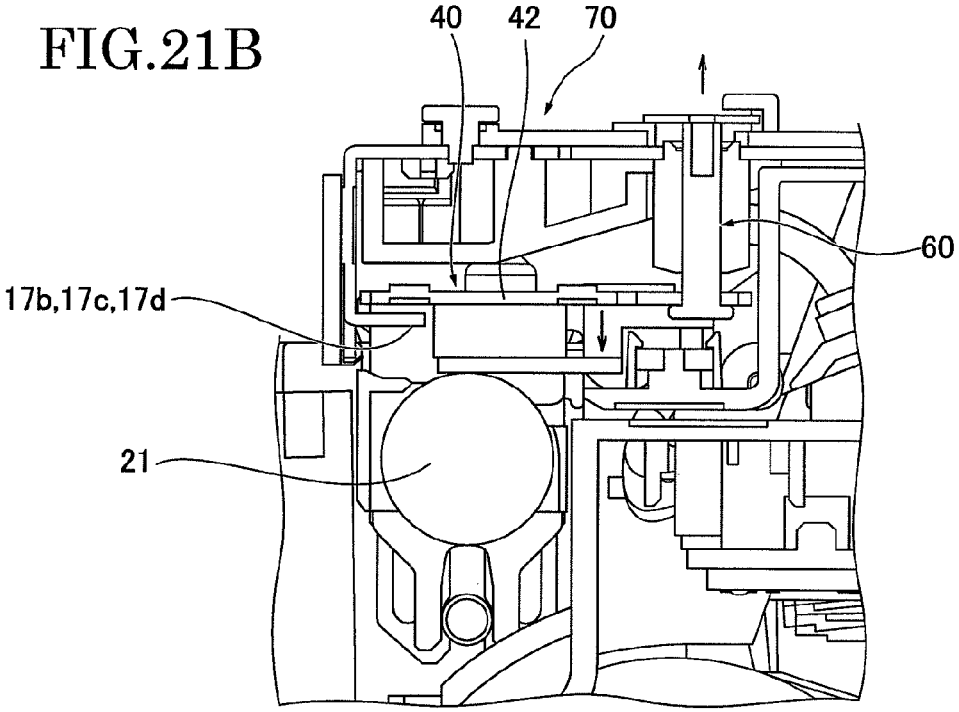

FIGS. 21A, 21B are perspective views showing the relation among the platen roller 21, thermal printhead unit 40, claws 17*b*, 17*c*, 17*d*, stepped pin 60, and stepped pin adjuster element 70. FIG. 21A shows that the right side (upstream side of the feeding direction of the thermal paper 200) of the thermal printhead unit 40 is inclined downward by the stepped pin adjuster element 70 shown in FIGS. 13A to 13C, and FIG. 21B shows that the same is inclined upward by the stepped pin adjuster element 70 shown in FIGS. 12A to 12C.

Figure 22A:
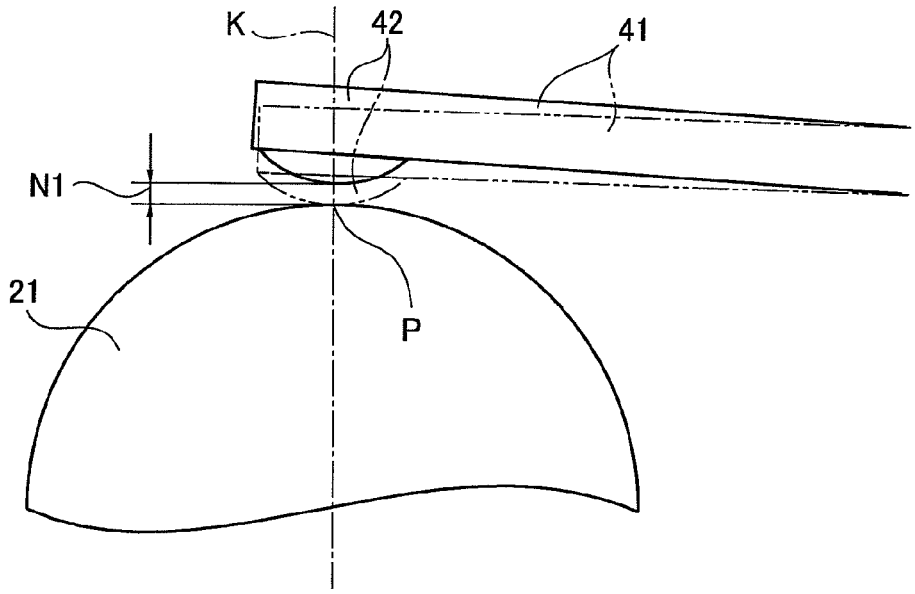
FIG. 22A shows how the thermal printhead unit is inclined when a thick thermal paper enters into a contact point between the exothermic element array and the platen roller.
Figure 22B:
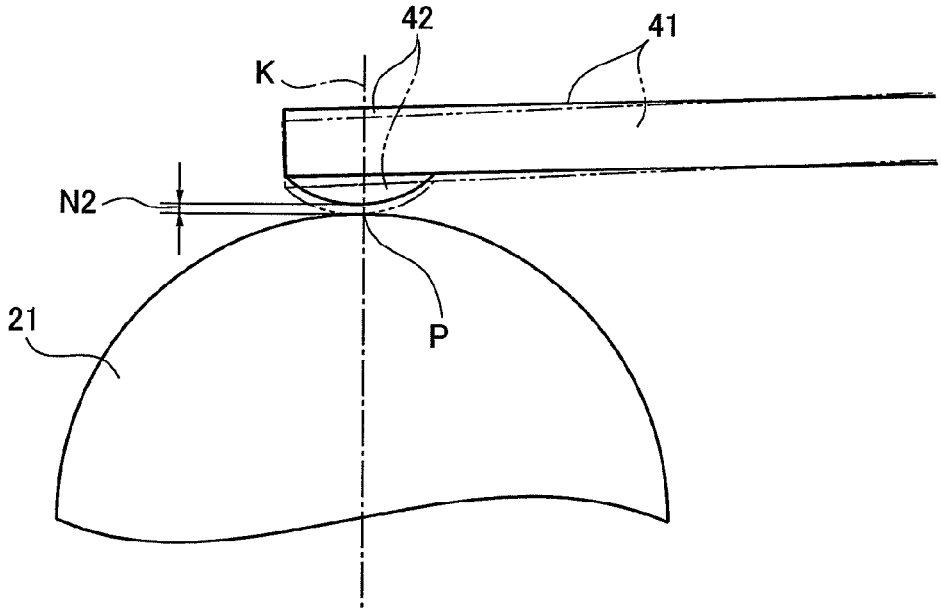
FIG. 22B shows the same when a thin thermal paper enters into the contact point.

FIGS. 22A, 22B show in detail the positional relation between the platen roller 21 and the exothermic element array 42 of the thermal printhead 41 of FIGS. 21A, 21B, respectively.

As described above, the two protrusions 46 of the thermal printhead unit 40 are provided on the extension line of the exothermic element array 42 and the positioning notches 22*i*, 23*i* engaging with the protrusions 46 are on the vertical line K passing on the center of the platen roller 21. Accordingly, a contact point P of the platen roller 21 and the exothermic element array 42 is always on the vertical line K irrespective of the inclination of the thermal printhead 41.

In FIG. 22A, when a thick thermal paper 200 (in thickness N1 for example) is delivered between the platen roller 21 and the exothermic element array 42, the thermal printhead unit 40 is inclined upward by the thickness N1 against the bias force of the springs 19*a* to 19*d*. The movement of the thermal printhead unit 40 is the rotation around the notch portion 45 and parallel movement on the vertical line K, as indicated by the double-dashed line in the drawing.

Figure 23A:
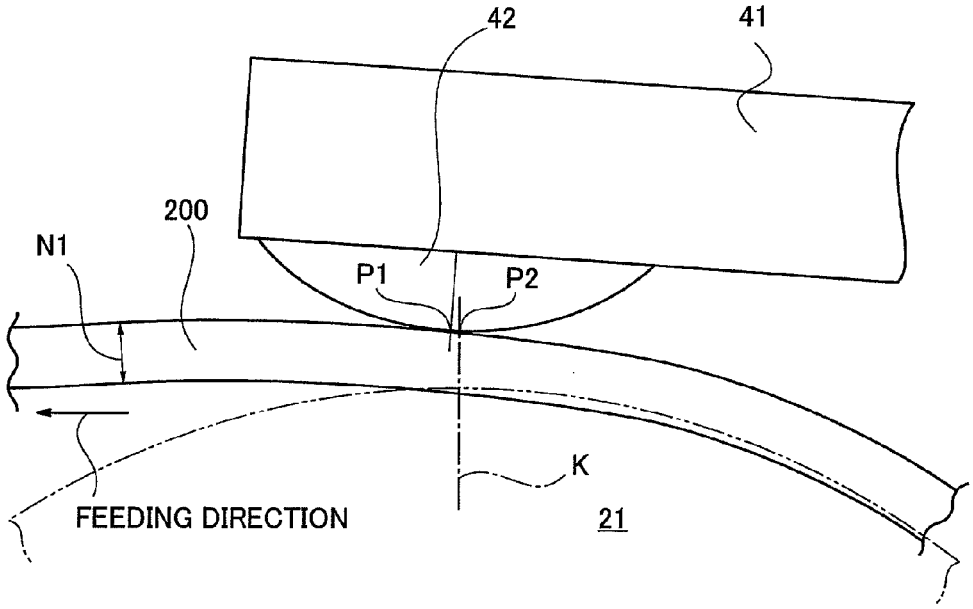
FIG. 23A shows a contact point between the exothermic element array and a paper in detail when the thermal printhead unit is inclined along with a thick thermal paper.

The contact point of the thermal paper 200 and the exothermic element array 42 is a point P2 in FIG. 23A.

Meanwhile, in FIG. 22B, when a thin thermal paper 200 (in thickness N2 (<N1) is delivered between the platen roller 21 and the exothermic element array 42, the thermal printhead unit is inclined upward in the drawing by the thickness N2 against the bias force of the springs 19*a* to 19*d*. The movement of the thermal printhead unit 40 is parallel to the rotation around the notch portion 45 on the vertical line K, as indicated by the double-dashed line in the drawing.

Figure 23B:
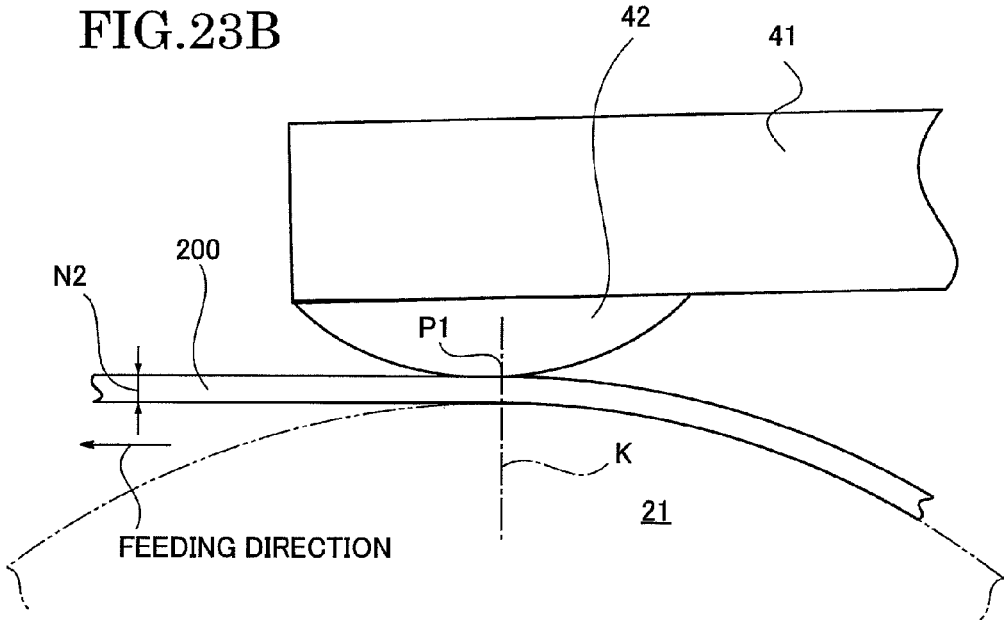
FIG. 23B shows the same when the thermal printhead unit is inclined along with a thin thermal paper.

The contact point of the thermal paper 200 and the exothermic element array 42 is a point P1 in FIG. 23B.

That is, the contact point P2 of the thick thermal paper 200 and the exothermic element array 42 comes more upstream in the feeding direction of the thermal paper 200 than the contact point P1 of the thin thermal paper 200 and the element array 41.

The thick thermal paper 200 exerts a higher rigidity than the thin thermal paper 200. It is supposed to closely contact with the exothermic element array 42 at the point P2 exactly above the point P as shown in FIG. 23A. However, in reality it is properly brought into close contact at the point P1 more downstream that the point P2 because of the high rigidity. This is because the rigidity of the thick thermal paper 200 causes the elastic circumferential surface of the platen roller 21 to not arc-like but be linearly deformed so that the contact between the paper 200 and the array 42 is weak or the two do not contact at all at the point P2.

Meanwhile, in case of the thin thermal paper 200 with a lower rigidity, it properly closely contacts with the exothermic element array 42 at the point P1 more downstream than the point P2 as shown in FIG. 23B.

Thus, the thermal printer 100 according to the present embodiment is configured that the exothermic element array 42 always contacts with the thermal paper 200 at the same point (P1) properly irrespective of the thickness of the thermal paper 200 so that it can realize high-quality printing irrespective of the thickness of the thermal paper 200

In the thermal printer 100, the thermal printhead 41 and the platen roller 21 are separately structured. Because of this, the thermal paper 200 can be set easily by such a simple operation as closing the cover element 12 (moving it to the closed position).

Moreover, in the thermal printer 100 the thermal printhead unit 40 is manually attachable/detachable to/from the cover frame 17 without any tools; therefore, replacement thereof can be easily done.

Likewise, the platen roller unit 20 is manually attachable/detachable to/from the body frame 18 without any tools; therefore, replacement thereof can be easily done.

According to the thermal printer of the embodiment of the present invention, the entire size of the thermal printer, especially a length in a front-back direction (feeding direction of a paper) can be reduced.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. A thermal printer comprising:

a body provided with a platen roller;

a cover element including a cover frame and configured to open and close said body;

a thermal printhead attached to said cover element;

a paper container provided in said body and configured to house paper therein; and a head cover damper unit comprised of a head cover configured to at least partially cover said thermal printhead, and a damper pivotally mounted to an upstream end of said head cover so as to be located along a paper feeding path between said paper container and said thermal printhead, said damper being configured to press the paper fed through the paper feeding path, and said head cover and said damper being combined into one integral unit attached to said cover frame and located within said cover element.

2. The thermal printer of claim 1, wherein:

said paper container is configured to accommodate a roll of paper;

said damper comprises a damper plate pivotally mounted to said head cover so as to be pivotable through a predetermined angle range with respect to said head cover, and a turning bias member configured to bias said damper plate in one direction through said predetermined angle range; and said damper is located along the paper feeding path such that the paper contacts a surface of said damper plate, said surface being directed in a bias direction of said turning bias member.

3. The thermal printer of claim 2, wherein said head cover has a paper detection mechanism configured to detect the paper fed through the paper feeding path.

4. The thermal printer of claim 1, wherein said head cover has a paper detection mechanism configured to detect the paper fed through the paper feeding path.

5. The thermal printer according to claim 1, wherein said head cover damper unit is detachably mounted to said cover frame via an elastic protrusion so as to be removable from said cover frame as an entire unit.

6. The thermal printer according to claim 1, wherein said cover frame includes:

an adjustable stepped pin protruding through a notch in a thermal printhead unit housing said thermal printhead; and a stepped pin adjuster element for adjusting a position of said stepped pin so as to thereby adjust a position of said thermal printhead relative to said cover frame.

7. The thermal printer according to claim 1, wherein:

said platen roller is configured to press against said thermal printhead such that the paper fed through the paper feeding path is fed between said platen roller and said thermal printhead; and a paper separating frame for guiding paper which has been fed between said platen roller and said thermal printhead.

* * * * *